US011118343B2

(12) United States Patent
Sayed

(10) Patent No.: US 11,118,343 B2
(45) Date of Patent: Sep. 14, 2021

(54) ARCHITECTURAL STRUCTURE

(71) Applicant: Biohm Limited, London (GB)

(72) Inventor: Ehab Sayed, London (GB)

(73) Assignee: BIOHM LIMITED, London (GB)

( * ) Notice: Subject to any disclaimer, the term of this patent is extended or adjusted under 35 U.S.C. 154(b) by 0 days.

(21) Appl. No.: 16/342,823

(22) PCT Filed: Oct. 24, 2017

(86) PCT No.: PCT/GB2017/053193
§ 371 (c)(1),
(2) Date: Apr. 17, 2019

(87) PCT Pub. No.: WO2018/078346
PCT Pub. Date: May 3, 2018

(65) Prior Publication Data

US 2019/0234061 A1 Aug. 1, 2019

(30) Foreign Application Priority Data

Oct. 25, 2016 (GB) ..... 1618013

(51) Int. Cl.
*E04B 1/343* (2006.01)
*E04H 1/04* (2006.01)
(Continued)

(52) U.S. Cl.
CPC ..... *E04B 1/34321* (2013.01); *E04C 2/30* (2013.01); *E04H 1/04* (2013.01); *E04B 1/6112* (2013.01);
(Continued)

(58) Field of Classification Search
CPC ..... E04B 31/34321; E04B 31/3211
See application file for complete search history.

(56) References Cited

U.S. PATENT DOCUMENTS 2,924,858 A 2/1960 Couse et al.
3,359,694 A 12/1967 Hein
(Continued)

FOREIGN PATENT DOCUMENTS

CN 1193287 A 9/1998
CN 1911483 A 2/2007
(Continued)

OTHER PUBLICATIONS

Search Report under Section 17(5) for United Kingdom Patent Application No. GB1618013.5 dated Mar. 23, 2017 (4 pages).
(Continued)

*Primary Examiner* — Babajide A Demuren
(74) *Attorney, Agent, or Firm* — Withrow & Terranova, P.L.L.C.

(57) ABSTRACT

An architectural structure in accordance with the invention comprises at least one substantially planar component in the form of a wall (9, 10, 12, 13, 14, 15, 16), floor or ceiling, the at least one planar component comprising a plurality of identically sized right angled panels A each having the form of a 30°-60°-90° right angled triangles and a plurality of identically sized isosceles panels B each having the form of a 30°-120°-30° isosceles triangle. The invention may provide a building (11) which is constructed from a relatively small selection of prefabricated components, but which provides an architect with a relatively large degree of flexibility in the design of the structure. The invention may also permit a building (11) to be assembled without a binder or other fastenings between the majority of the components and therefore assist in the efficient deconstruction of the building, either at the end of its life or if the building is to be modified or rebuilt.

20 Claims, 26 Drawing Sheets

(51) Int. Cl.
*E04C 2/30* (2006.01)
*E04B 1/61* (2006.01)
*E04B 1/00* (2006.01)

(52) U.S. Cl.
CPC ..... *E04B 2001/0092* (2013.01); *E04B 2001/6191* (2013.01)

(56) References Cited

U.S. PATENT DOCUMENTS 3,418,778 A 12/1968 Foster
3,660,952 A * 5/1972 Wilson ..... E04B 1/10 52/81.4
3,925,940 A * 12/1975 O'Connell, Jr. ..... E04B 1/3211 52/81.1
3,974,600 A 8/1976 Pearce
4,186,533 A * 2/1980 Jensen ..... E04B 2/7425 52/184
4,261,467 A 4/1981 Shariff et al.
4,287,690 A * 9/1981 Berger ..... E04B 1/3211 52/81.4
4,422,267 A * 12/1983 Whitehouse ..... E04B 1/3211 52/81.1
4,425,740 A 1/1984 Golden
4,611,441 A * 9/1986 Wickens ..... E04B 1/3211 52/81.4
4,621,467 A 11/1986 Golden
4,723,382 A 2/1988 Lalvani
4,798,032 A * 1/1989 Rose, Jr. ..... E04B 1/3211 52/309.9
5,261,194 A * 11/1993 Roberts ..... E04B 1/3211 52/285.1
5,452,555 A * 9/1995 Lee ..... E04B 1/3211 403/388
5,732,514 A * 3/1998 Organ ..... E04B 1/3211 52/80.1
6,282,849 B1 9/2001 Tuczek
6,935,075 B2 * 8/2005 Sherman ..... E04B 1/08 446/108
9,103,110 B1 * 8/2015 Gerber ..... E04B 1/3211
10,392,800 B1 * 8/2019 Shin ..... E04C 2/34
10,415,231 B1 * 9/2019 Pramov ..... E04B 1/34321
2002/0088185 A1 * 7/2002 Miller ..... E04B 1/3211 52/81.4
2003/0097801 A1 5/2003 Hoberman
2004/0221529 A1 11/2004 Zornes
2008/0066393 A1 3/2008 Sorensen
2012/0318314 A1 * 12/2012 Okuda ..... E04H 1/1205 135/96
2014/0155182 A1 * 6/2014 DeBlanco ..... A63H 33/008 472/136
2016/0258152 A1 * 9/2016 Bierschenk ..... C04B 28/34

FOREIGN PATENT DOCUMENTS

CN 101300052 A 11/2008
CN 103649433 A 3/2014
GB 2302700 A 1/1997
NL 7509873 A 2/1977

OTHER PUBLICATIONS

International Search Report (Form PCT/ISA/210) for International Application No. PCT/GB2017/053193 dated Jan. 22, 2018 (3 pages).
Written Opinion of the International Searching Authority (Form PCT/ISA/237) for International Application No. PCT/GB2017/053193 dated Jan. 22, 2018 (5 page).
Office Action for Chinese Patent Application No. 201790066083.6 dated Jul. 16, 2020 (19 pages including English translation).
Official Action for Eurasian Patent Application No. 201990852/31 dated May 26, 2020 (7 pages including English translation).
Office Action for Chinese Patent Application No. 2017900660836 dated Jul. 16, 2020 (15 pages including English ranslation).
English translation of Second Office Action for Chinese Patent Application No. 2017800660836, dated Dec. 28, 2020, 9 pages.
English translation of Official Action for Eurasian Patent Application No. 201990852/31 dated Feb. 11, 2021, 3 pages.

* cited by examiner

Figure 4
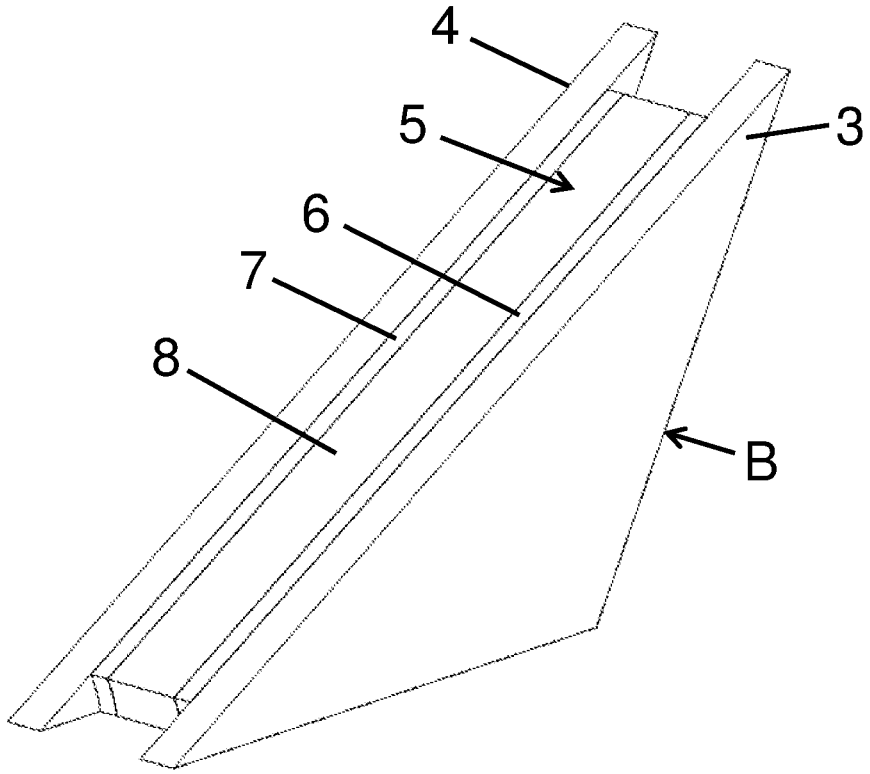
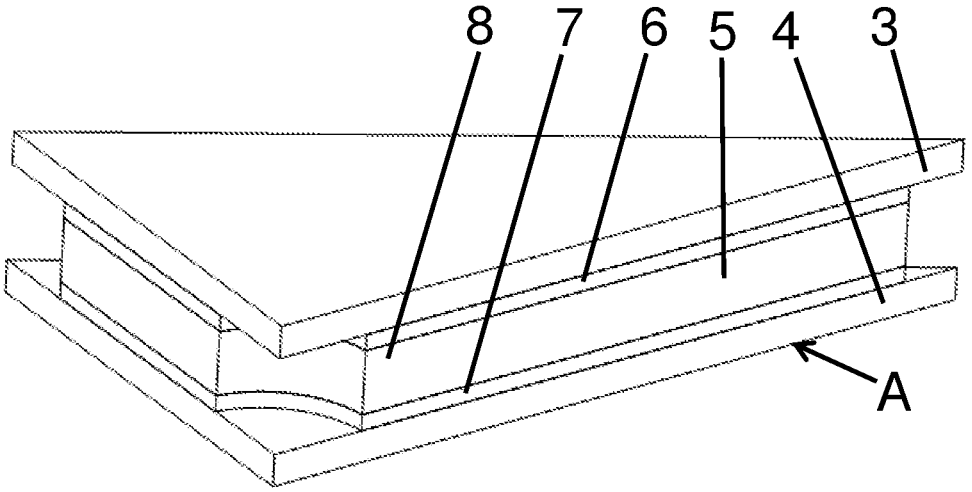
Figure 5

ARCHITECTURAL STRUCTURE

This application is a 35 U.S.C. § 371 national phase filing of International Application No. PCT/GB2017/053193 filed on Oct. 24, 2017, and claims the benefit of United Kingdom Patent Application No. 1618013.5 filed on Oct. 25, 2016, wherein the entire disclosures of the foregoing applications are hereby incorporated by reference herein.

The present invention relates to an architectural structure and particularly, but not exclusively, to a building, which is constructed from a relatively small selection of prefabricated components, which are designed to provide an architect with a relatively large degree of flexibility in the design of the structure.

To minimise construction costs and time, there is a desire for buildings which can be partly built (assembled) off site from prefabricated components, or for buildings to be built onsite from prefabricated components. This is because it is normally more cost effective to form components, or construct sections, of a building in a factory environment, where they may be manufactured or constructed on a production line basis which is not dependent on the prevailing weather conditions. Additionally, a building formed from prefabricated components, or sections, may be more rapidly assembled on site, thus reducing the time between purchase or clearance of a site and commissioning of the new building.

In addition to the above there is a desire, for environmental reasons, for buildings to be able to be efficiently deconstructed, rather than being demolished. If the components of a building can be relatively easily disassembled, then where those components are substantially homogenous in nature, the different materials of the building can be segregated relatively easily for recycling.

The ability to construct a building from components, or section, formed off site and to then be able to deconstruct that same building results in a greatly reduced carbon footprint for that building relative to an equivalent traditional building.

Building off site may also enable building methods or construction methods to be used in the manufacture of components or sections of a building, which could not normally be performed on site. This may permit components or sections of a building to be produced in such a way that they may be both structural and thermally insulating in nature.

Although, for the above reasoning, there is a desire for buildings to be constructed of standard built-off-site components or sections, it is also desirable that buildings exhibit an individual character, both for aesthetic considerations and also to permit buildings to be designed for a specific purpose or individual. Therefore there is a need for architectural structures, and particularly buildings, which can be fabricated from a number of standard components or sections, but which components or sections still permit an architect to tailor a building made from such components, or sections, to a particular requirement.

It is an object of the present invention to provide an architectural structure built from such components.

According to a first aspect of the present invention there is provided an architectural structure comprising of at least one substantially planar component in the form of a wall, floor or ceiling, the at least one planar component comprising a plurality of identically sized isosceles panels each having the form of a 30°-120°-30° isosceles triangle and a plurality of identically sized right angled panels each having the form of a 30°-60°-90° right angle triangle.

The terms "isosceles panel" and "isosceles panels" are used throughout this specification, including the claims, to refer to a panel or panels in the form of a 30°-120°-30° isosceles triangle. Similarly, throughout the specification the terms "right angled panel" and "right angled panels" refer to a panel or panels in the form of a 30°-60°-90° right angled triangle.

By appropriate selection of the size of the isosceles panels, relative to the size of the right angled panels, the panels may be laid out in one of an infinite number of combinations, depending on the number of panels available, on a grid pattern as illustrated in FIG. 20B. The dimensions of the panels and the placing of the panels may be arranged such that adjacent edges of the panels are parallel and nearly abut, leaving minimal gaps between the panels. In this way, such panels may form a major part of a substantially planar component of an architectural structure, such as a wall, floor or ceiling, whilst permitting an architect a significant amount of freedom in designing the overall shape of the wall, floor or ceiling, permitting the substantially planar component to have a large range of shapes which contain 30°, 60°, 90°, 120°, 150° and 240° angles.

With the exception of a peripheral edge portion, the whole of the planar component may be comprised of, and substantially filled by, non-overlapping ones of the pluralities of isosceles panels and right angled panels. In this manner, the panels may extend over substantially the whole of the planar component so that, by appropriate choice of materials for the panels, the panels may substantially form a weather proof barrier and/or provide a thermally insulating barrier.

The geometry of the two panel types works particularly well together where the relative size of the panel is selected such that the length of the long side of the right angled panels is approximately 1.2 times the length of the long side of the isosceles panels.

Preferably, the at least one planar component which is in the form of a wall, floor or ceiling, further comprises connecting members located between adjacent panels to hold the panels together. The provision of a connecting member between adjacent panels permits the adjacent panels to be easily assembled and subsequently disassembled, without the use of fixings or a binding agent. This may greatly assist with subsequent deconstruction, or if part of the structure is to be dismantled to permit the structure to be reconfigured.

Preferably, each connecting member comprises a planar front portion, a planar rear portion and an orthogonal portion extending between the front and rear portions to define a channel for receiving an edge of a panel, wherein the width of the channel is substantially equal to the thickness of the panel.

The above arrangement permits the panels to be simply slotted in place in the channels and if there is some degree of resilience in either of the panel or the connecting member, permits the panel to be substantially sealed within the connecting member. Furthermore, it is preferable that at least one of the planar front and rear portions of the connecting members extends sufficiently to cover any small gaps between adjacent panels. Thus the combination of panels and connecting members may be arranged to provide the at least one planar component with a weather proof outer surface. This is particularly the case where each connecting member defines two back to back channels for receiving respective edges of adjacent panels.

The planar front and rear portions of each connecting member are preferably trapezoidal and more preferably diamond shaped, with the orthogonal portion extending in the length direction of the diamond shape. This results in the planar front and rear portions tapering away at the ends of the connecting member, permitting two connecting members to extend along respective ones of two converging edges of a panel, without the planar front and rear portions of each connecting member obstructing one another. However, at their mid-points the planar front and rear portions of each connecting member extend significantly from the centre line of the connecting member and thereby define relatively deep channels in which the panels are supported, assisting the planar components, composed of such panels and connectors, to retain a planar configuration.

The important feature of the planar front and rear portions is that their furthest most apart tips, or ends, subtend an angle of 30°, in order to fit with the front and rear portions respectively of adjacent connecting members. Thus the trapezoidal shape is not essential. Furthermore, although a connecting member may have distinct front and rear planar portions, it could instead be in the form of an extrusion having relatively shallow grooves on either side in which to locate the panels.

The architectural structure preferably comprises three types of connecting member which are essentially identical in shape but are of three different sizes, each having a maximum dimension slightly greater than one of the edges of a panel.

Three such types of connecting member are sufficient to connect all combinations of adjacent panel edges of a planar component, such that the planar front and rear portions of each connecting member cover all gaps between adjacent panels.

In an alternative to the above, all of the three connecting members could instead be replaced by an appropriate number of smaller identical connecting members, such that an appropriate number of one single connecting member type could be used instead of the above three separate types.

Each connecting member is preferably homogeneous and is formed by being cast or moulded. Each connecting member may be formed of concrete which may be aerated autoclaved concrete. This may use incinerated sewage sludge ash (fly ash).

Preferably each panel is a structurally insulating panel, comprising two outer layers, which may be weather proof, and an internal insulating layer. The outer layers may be formed of concrete such as the aerated autoclaved concrete mentioned above. The insulating layer may comprise two outer insulating layers of mushroom board and an inner layer of mushroom foam. An advantage of this is that the mushroom board may be grown directly on to the concrete, with the mushroom foam then grown between the mushroom boards, avoiding the need to use any additionally binding materials in the prefabrication process and thus assist in deconstruction and reuse/recycling of the structure.

The insulating layer may have a cut-out, in the form of a part of a circle, formed at each vertex, with the at least one planar component further comprising a plurality of circular discs of insulating material of the same thickness as the insulating layers, which circular discs are positioned between adjacent vertices of adjacent panels.

The provision of circular discs of insulating material at the vertices, or between adjacent vertices, of adjacent panels ensures that gaps between the ends of adjacent connecting members do not align with gaps between the vertices of adjacent panels. Furthermore, circular discs and the cut-outs being in the form of a part circle arranged to accommodate such discs, permit a single type of disc to be accommodated regardless of the number and type of panel vertices which abut and partially accommodate the disc.

The architectural structure may comprise at least one peripheral frame for receiving at least one edge of the at least one planar component, wherein the at least one peripheral frame comprises a plurality of components shaped on an outer side to have a straight edge and shaped on an inner edge to receive the planar component.

The above arrangement permits the said at least one planar component to be accommodate in a frame and the frame to then provide a smooth linear edge for a wall, floor, ceiling or the like, necessary for that edge to form a top edge, bottom edge or corner of a building, or other architectural structure.

Preferably, the architectural structure comprises a plurality of connecting members located between adjacent panels and a plurality of edge pieces, which each correspond in shape and size to half of one of the connecting members, the edge pieces fitting over respective edges of panels to provide a smooth edge to the panel. Such edge pieces may be used to form portals for doors, windows or the like in the at least one planar component.

The invention is particularly applicable to architectural structures which are in the form of a building, where at least a portion of the floor of the building comprises the at least one planar component or wherein at least one wall of the building comprises the at least one planar component referred to above. The building may comprise a peripheral frame shaped for receiving the at least one planar component, the peripheral frame comprising two opposed upright corner pillars between which the at least one planar components is located.

The opposed upright corner pillars may act to retain the unbonded panels and connecting members in place and also provide vertical rigidity to the structure. Each corner pillar may comprise a single component extending vertically the height of a level of a building and the height of the at least one planar component.

Preferably, the architectural structure comprises at least two planar components, wherein one of said corner pillars is located between the two planar components, wherein the corner component is shaped to receive respective adjacent edges of the planar components when the planar components are angled relative to each other.

The angle may be 120°, in which case six such corner pillars will complete an orthogonal structure, but the corner pillars could alternatively be arranged to angle the adjacent planar components at some other angle, for example at 90° to each other.

A wall of the building may be formed by stacking panels and connecting members edge to edge on site to form said wall. Alternatively, one or more planar components comprising a plurality of panels and connecting members may be preassembled off site.

Although an architectural structure, or building, could have an outer frame as described above, alternatively angled structural connecting members, possibly similar to the planar connecting members described above, could be used to connect adjacent planar components at an appropriate angle relative to each other, to form corners between the walls, ceiling/roof or floors, without the need for a separate frame.

According to a second aspect of the present invention there is provided a method of constructing a building comprising assembling a planar component to form a wall, floor or ceiling from a plurality of identical isosceles panels each having the form of a 30°-120°-30° isosceles triangle and from a plurality of identical right angled panels each having the form of a 30°-60°-90° right angled triangle, the method comprising assembling the panels using intervening connecting members without any binder.

Several embodiments of the present invention will now be described, by way of example only, with reference to the accompanying figures, of which:

FIG. 4 is a perspective view of an isosceles panel (B);

FIG. 5 is a perspective view of a right angled panel (A);

Figure 29:
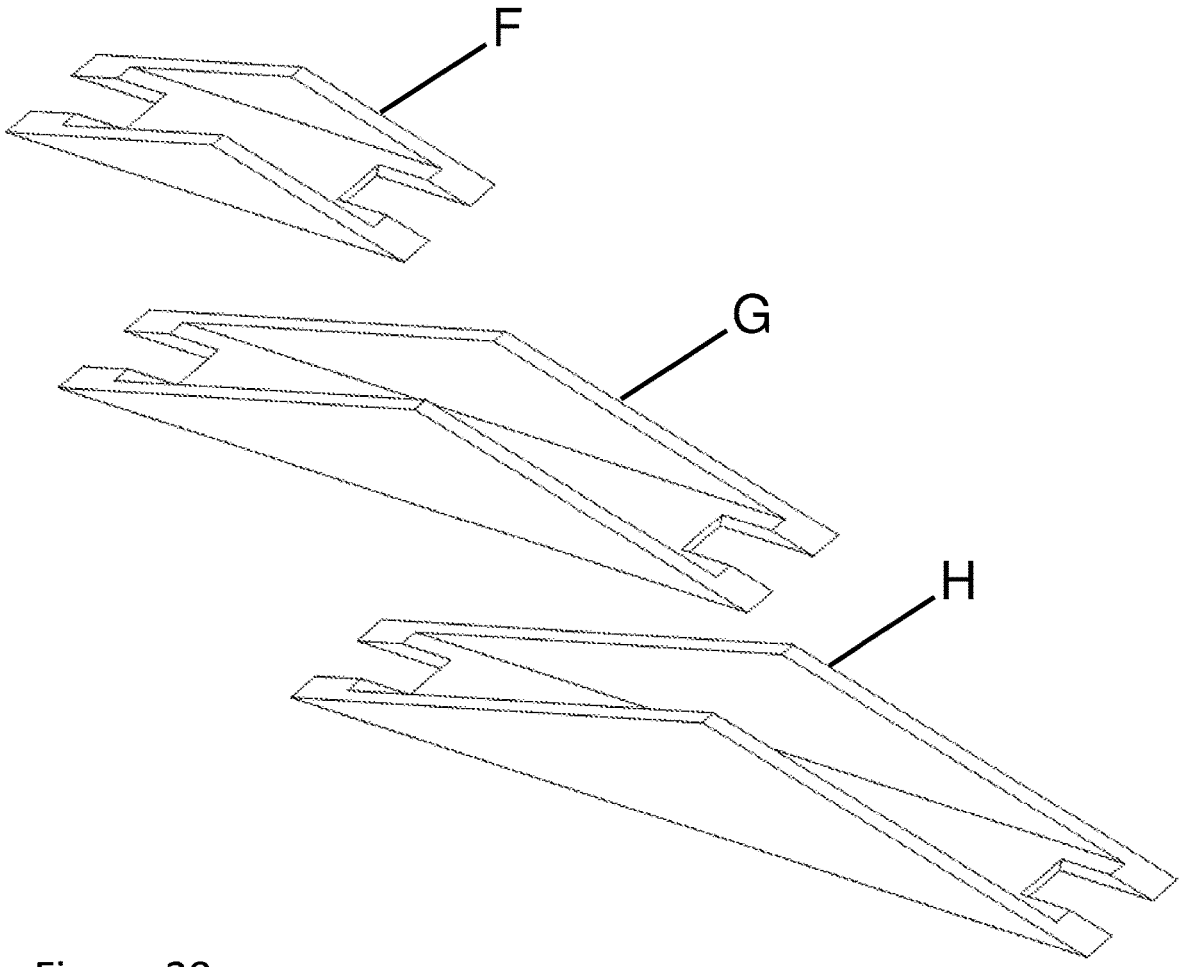
FIG. 29 is a perspective view of a small edge piece (F), a medium edge piece (G) and a large edge piece (H)
Figure 30:
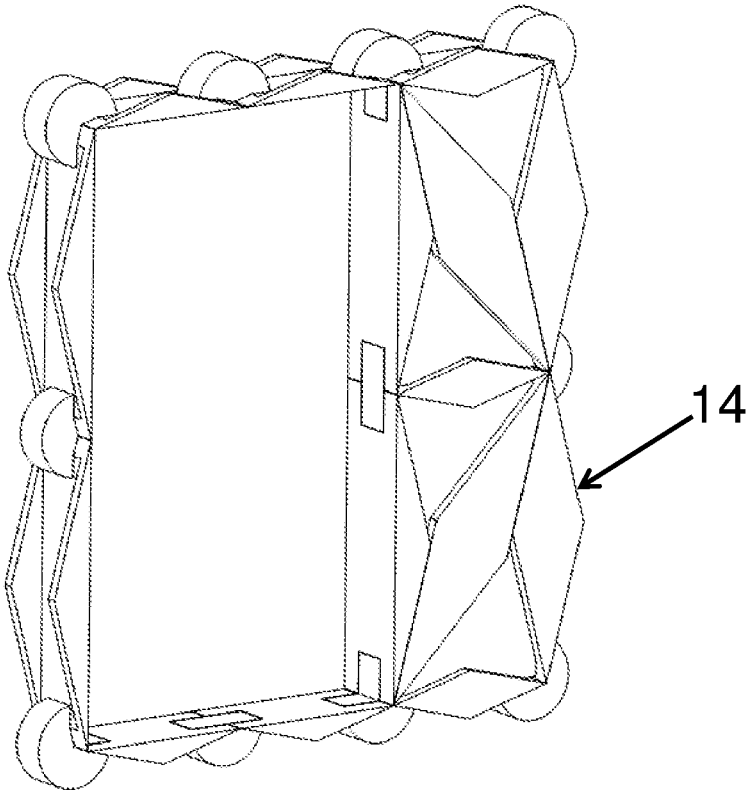
FIG. 30 shows a preassembled planar component of a wall of the building of FIG. 21 with some of the edge pieces of FIG. 29 forming a doorway.
Figure 31:
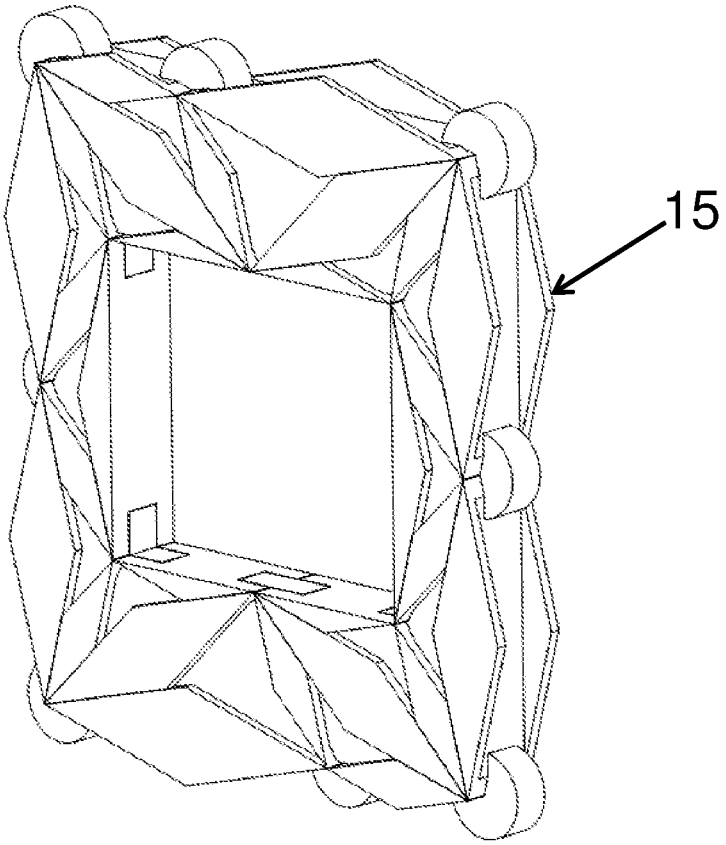
FIG. 31 is similar to FIG. 30 but with the edge pieces forming a window aperture.
Figure 32:
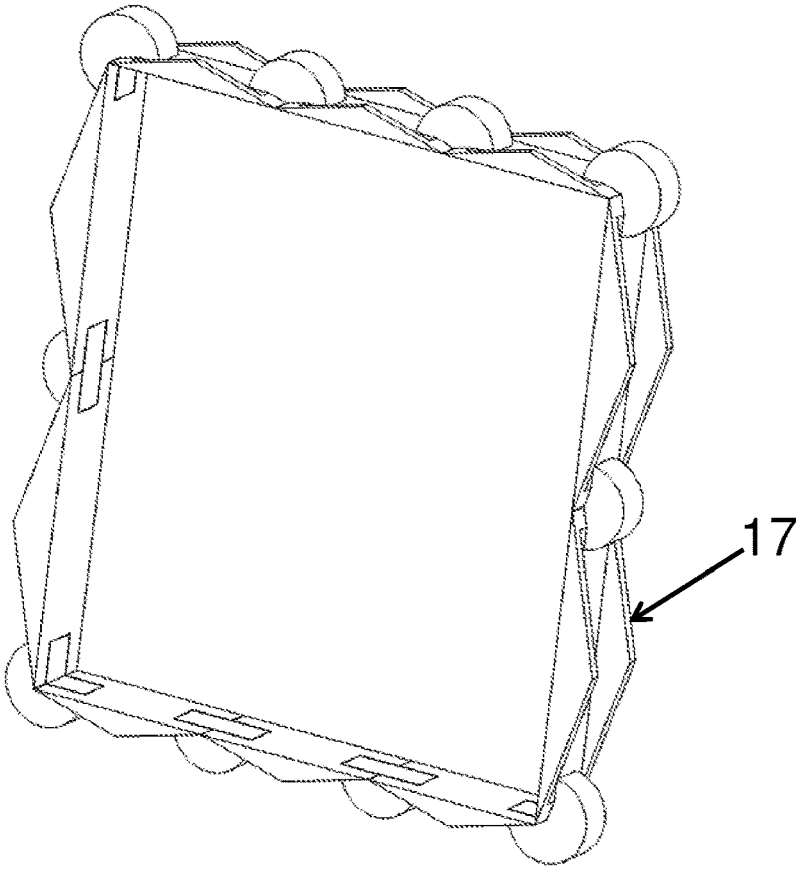
FIG. 32 illustrates how the edge pieces of FIG. 29 may be used to form the large aperture in a wall of the building of FIG. 21.
Figure 33:
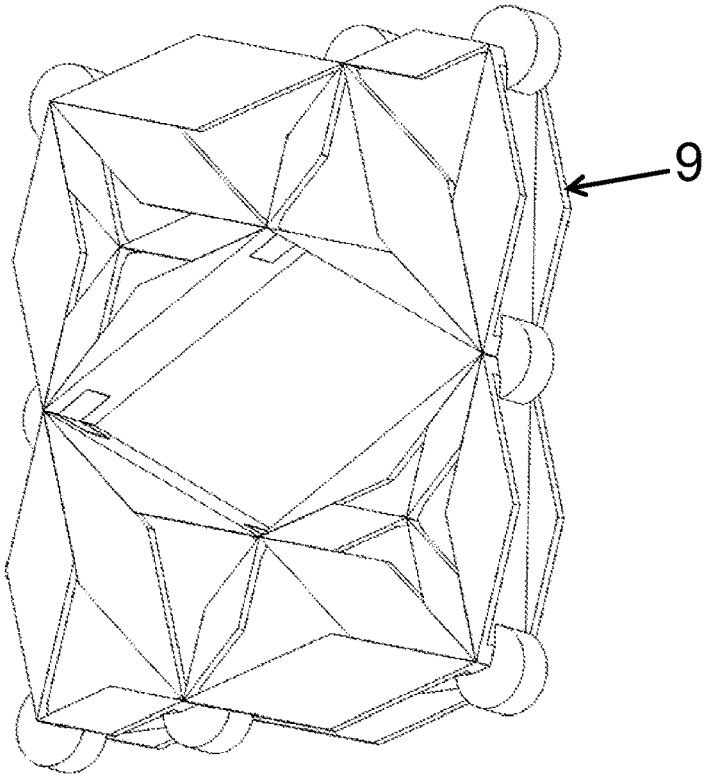
Figure 34:
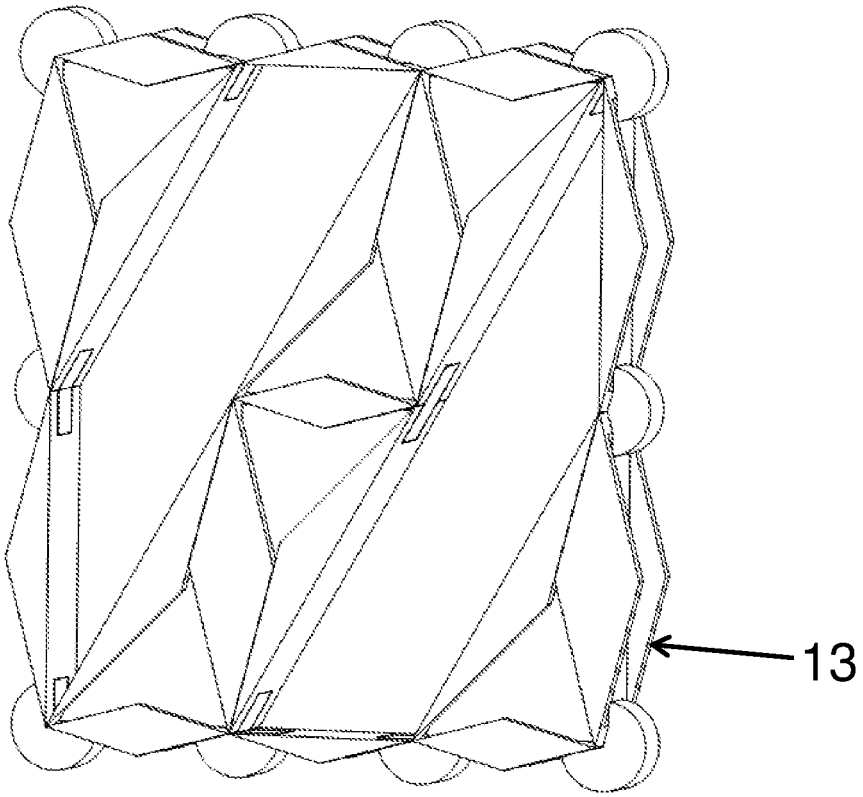
Figure 35:
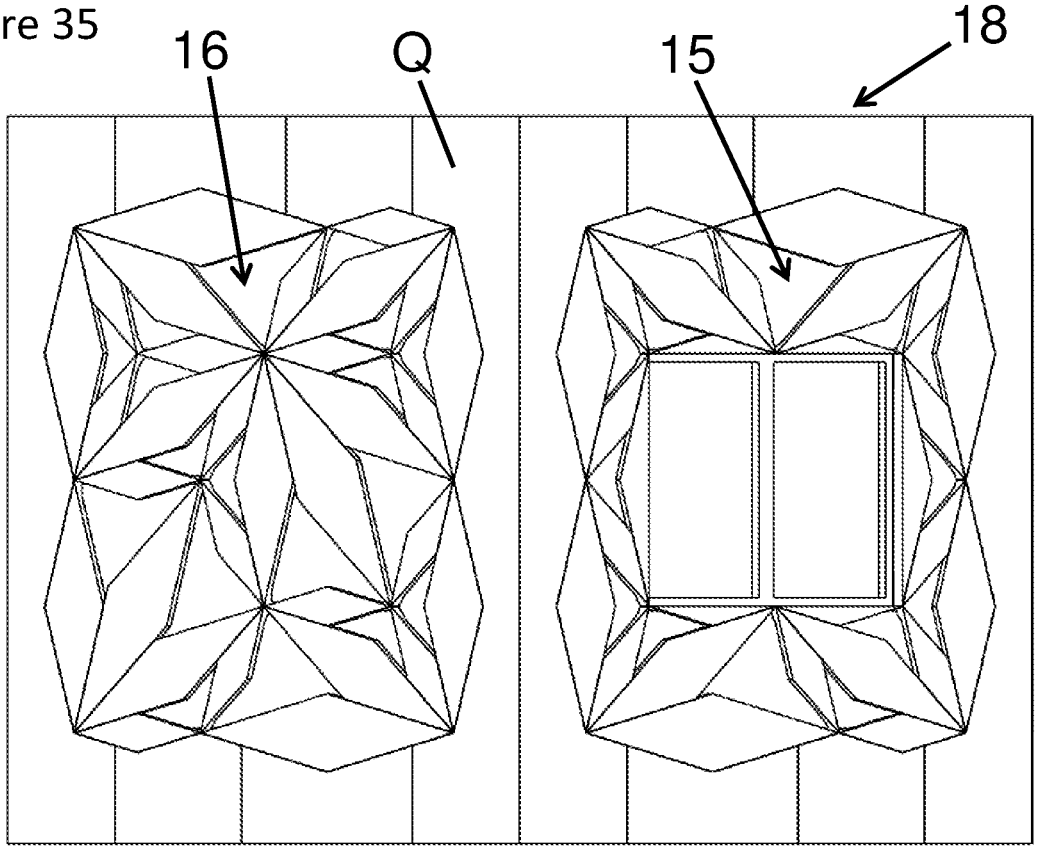
Figure 36:
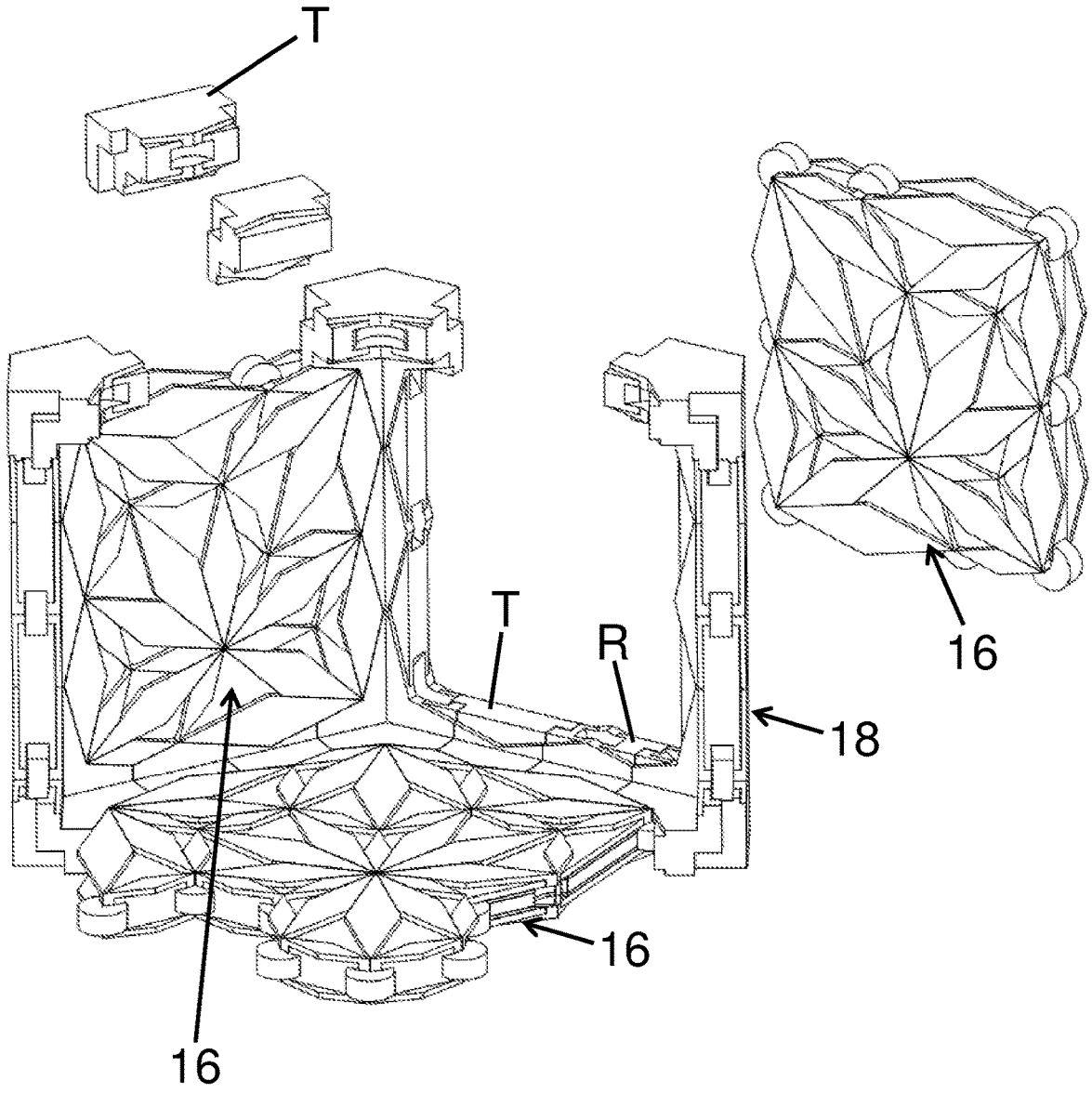
Figure 37:
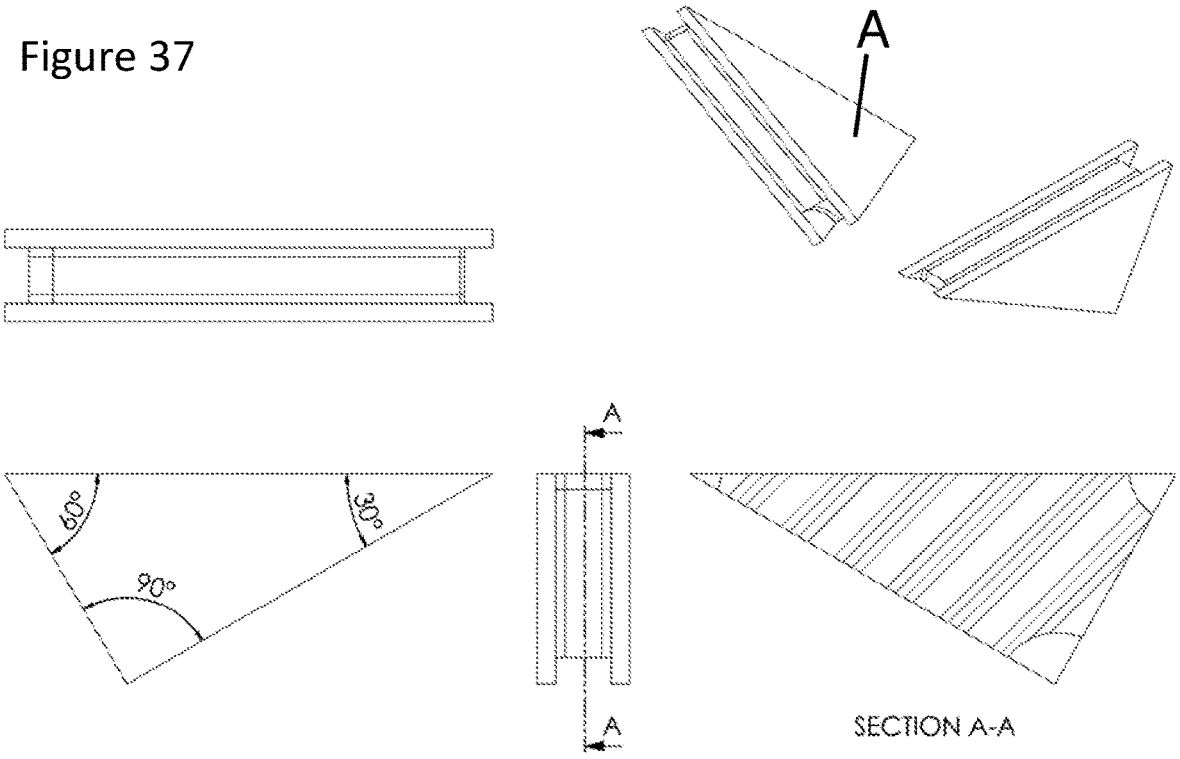
Figure 38:
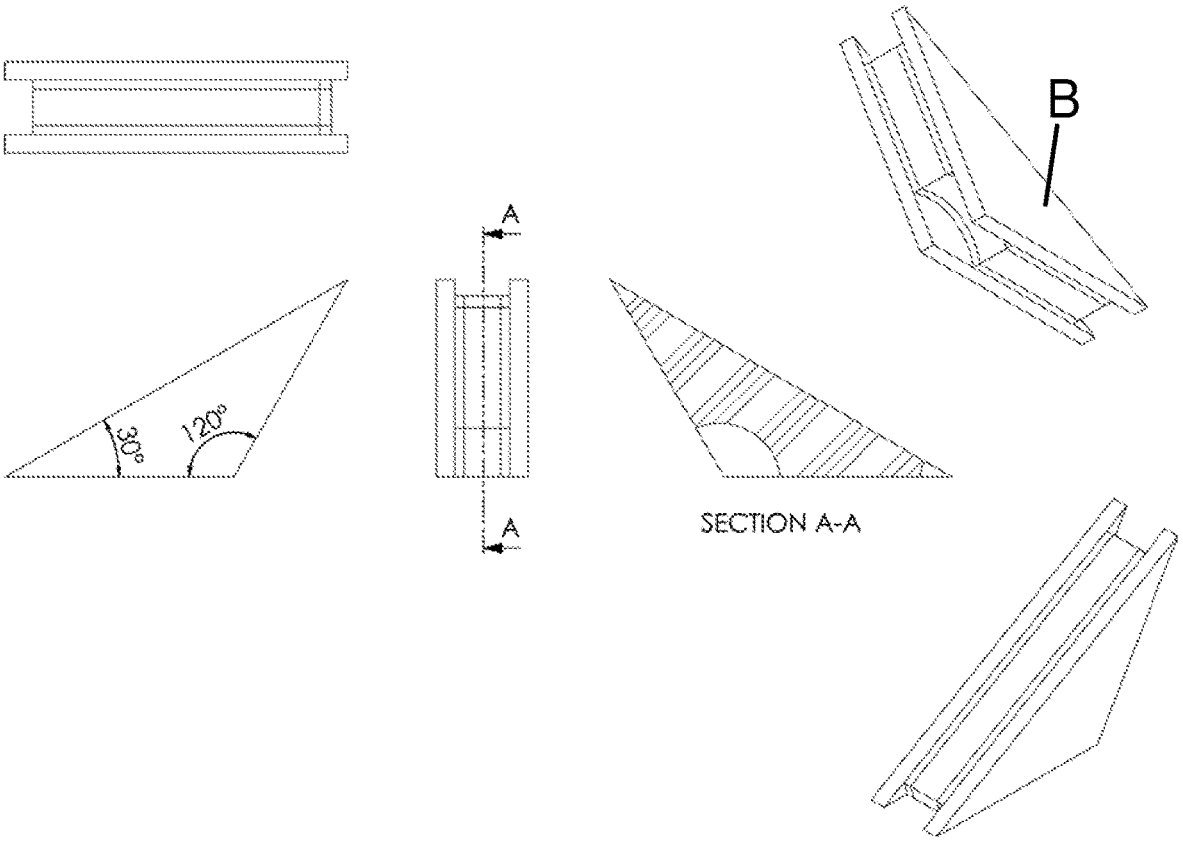
Figure 39:
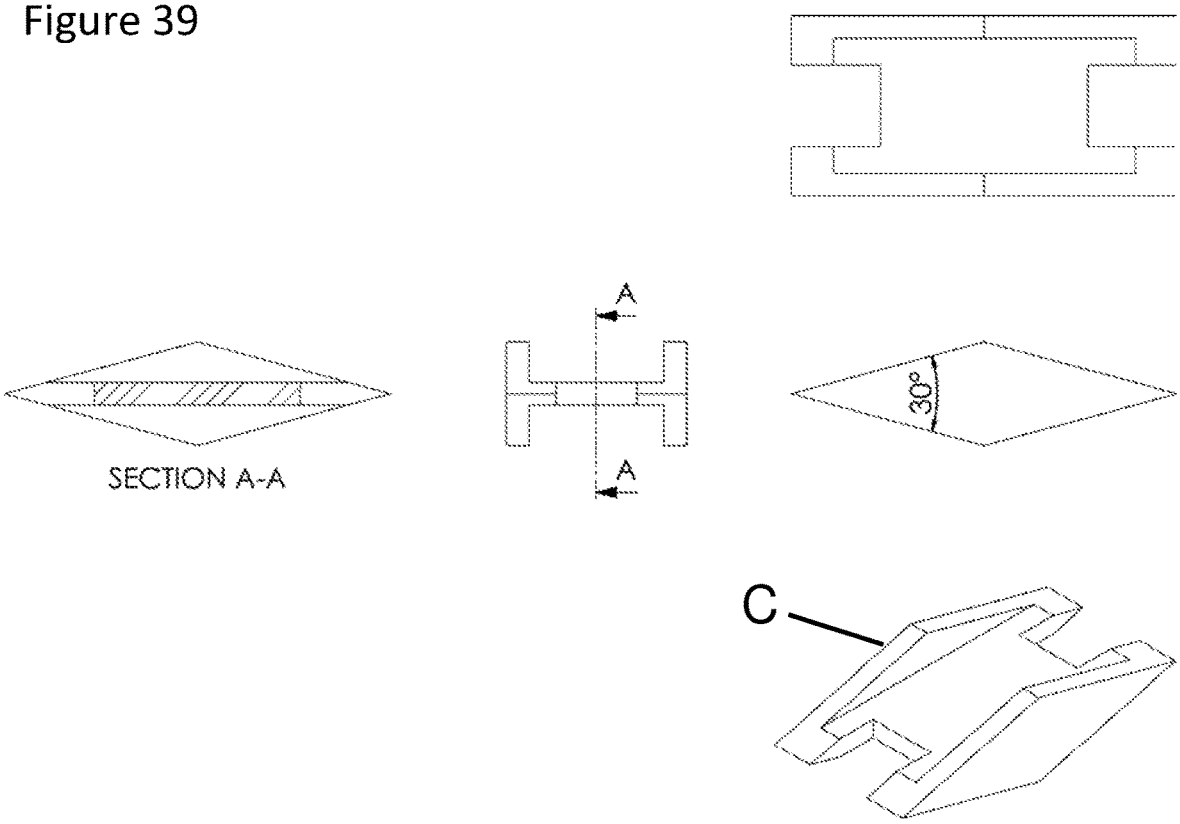
Figure 40:
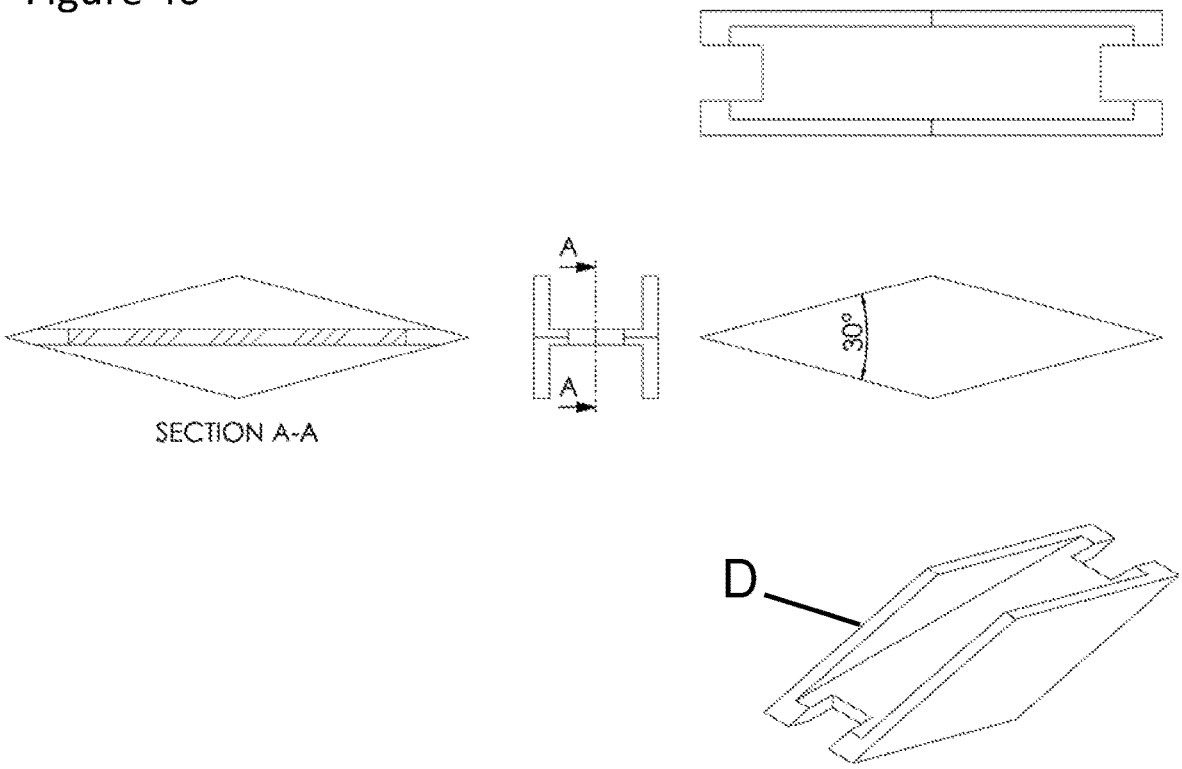
Figure 41:
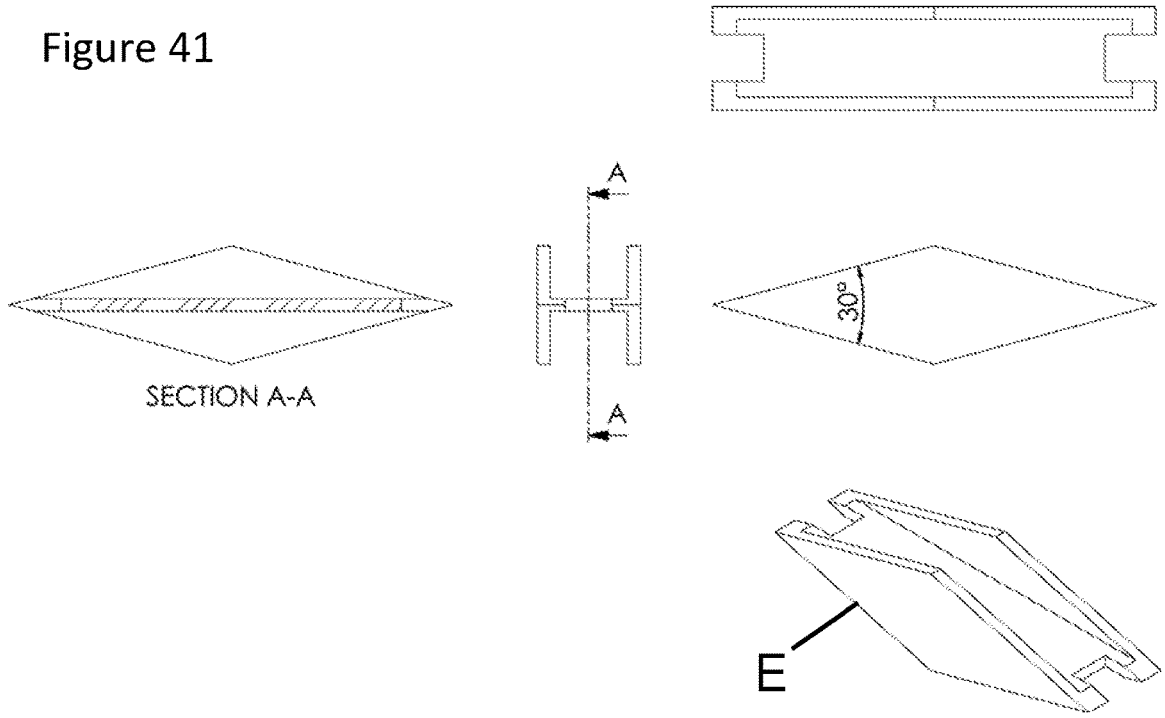
Figure 42:
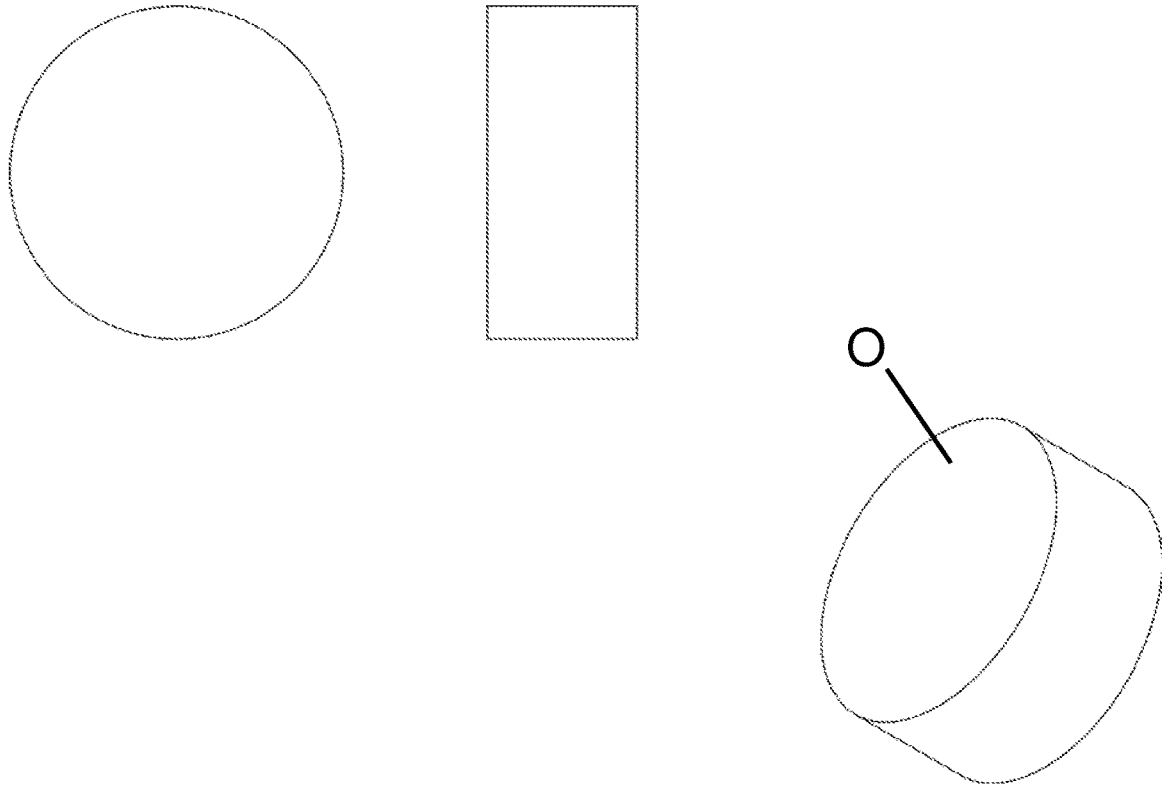
Figure 43:
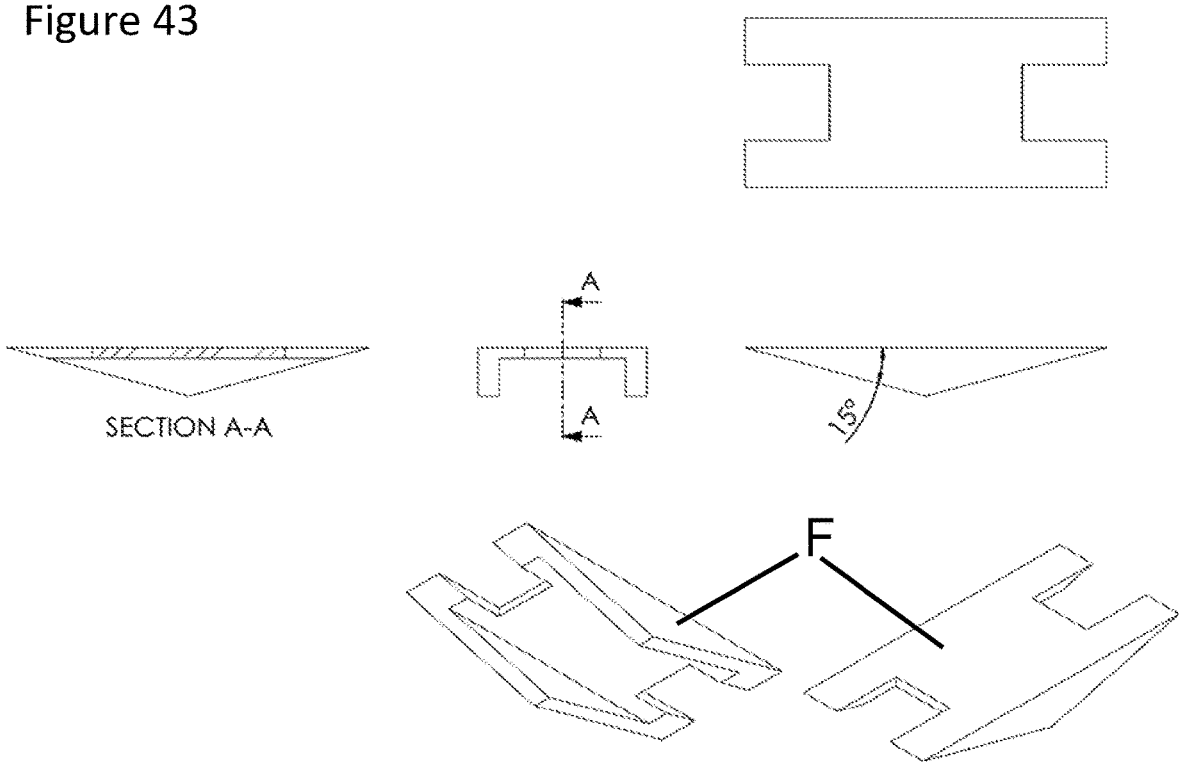
Figure 44:
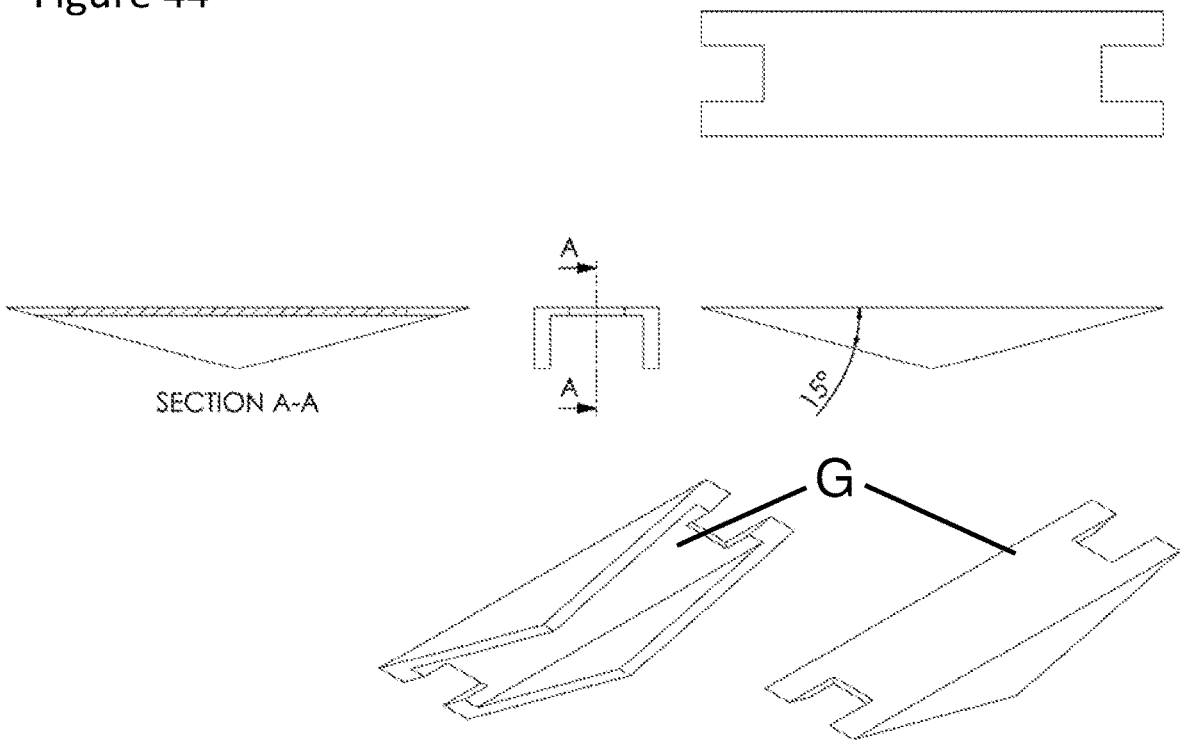
Figure 45:
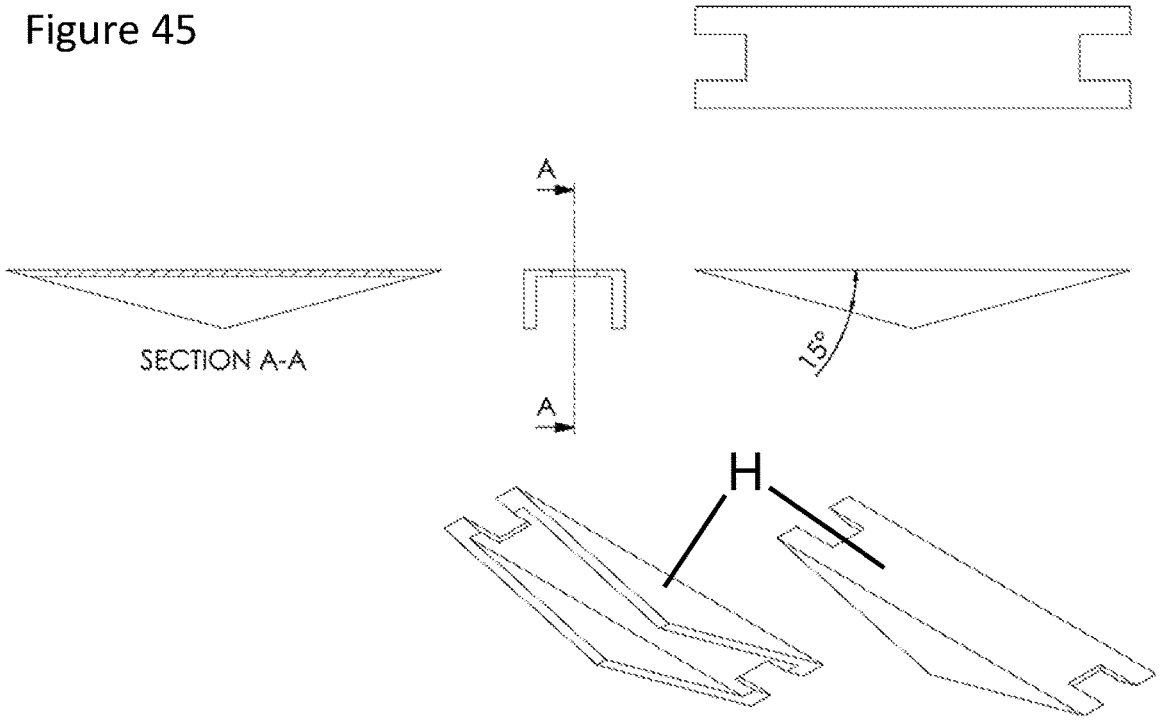
Figure 46:
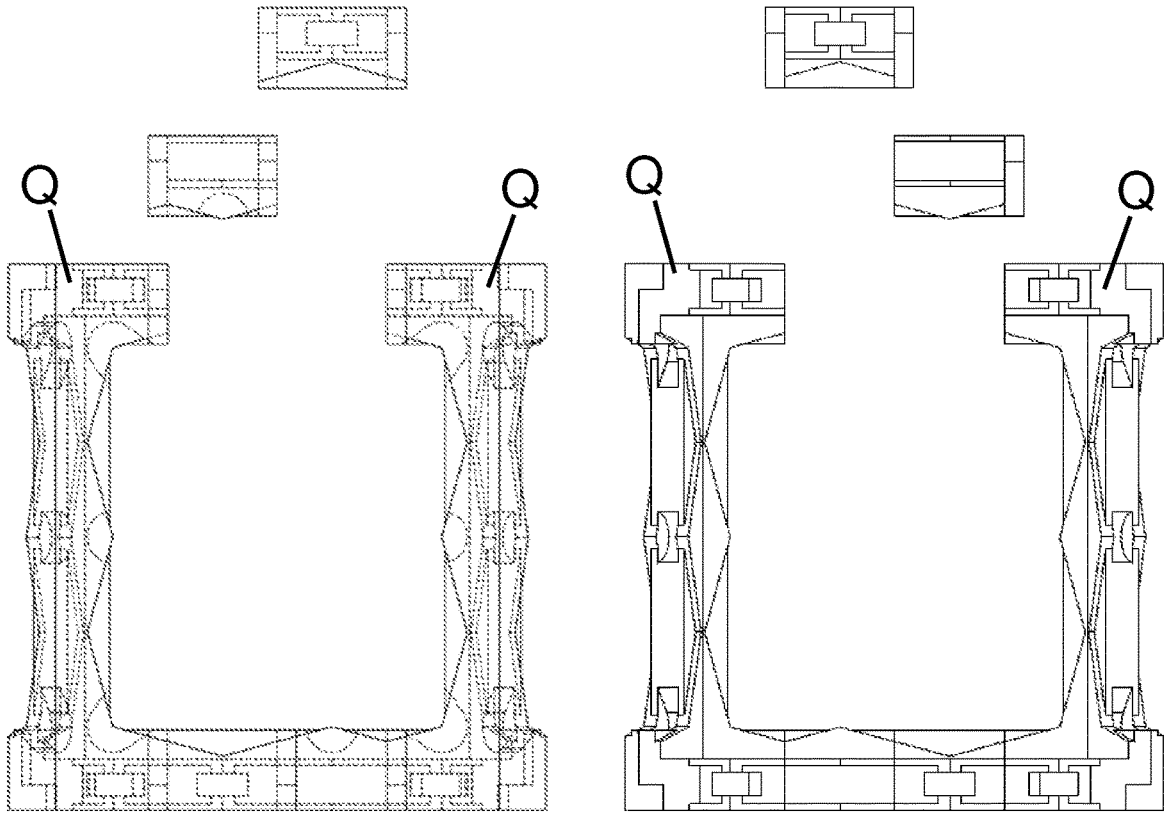
Figure 47:
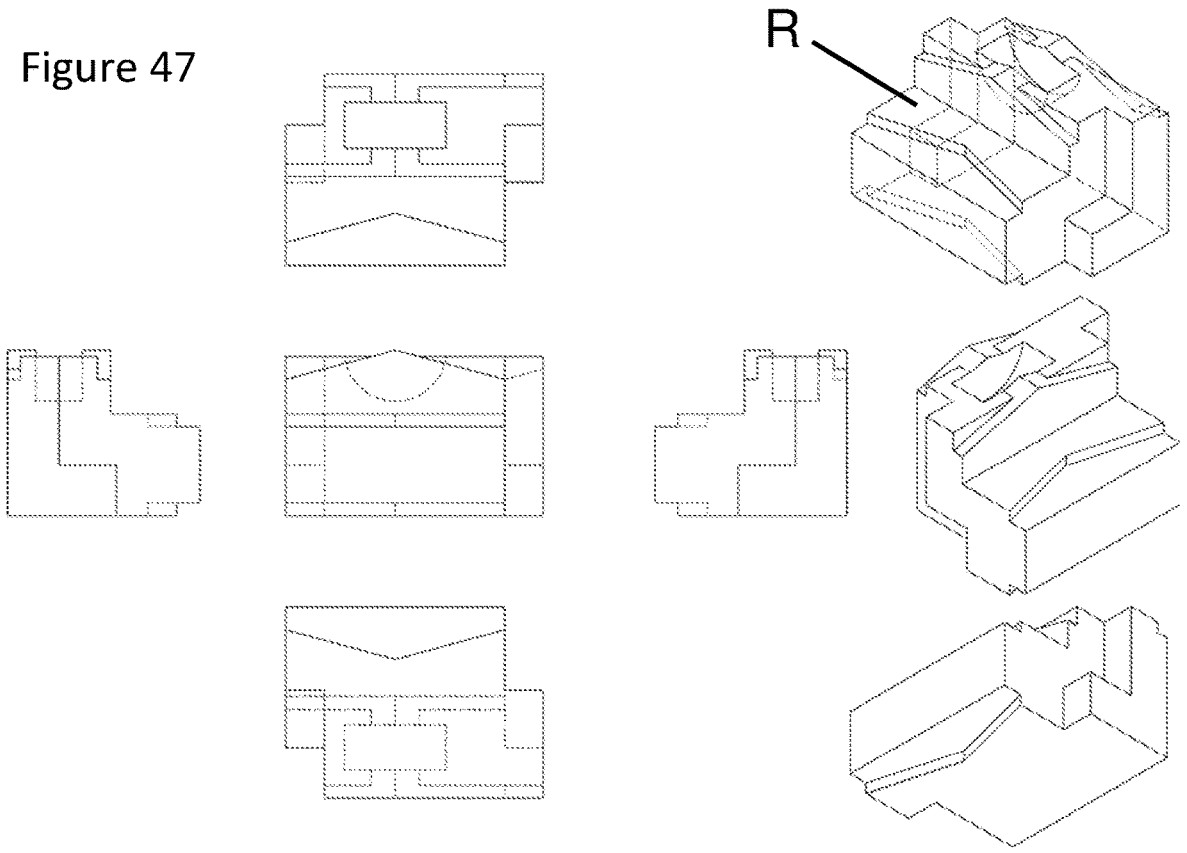
Figure 48:
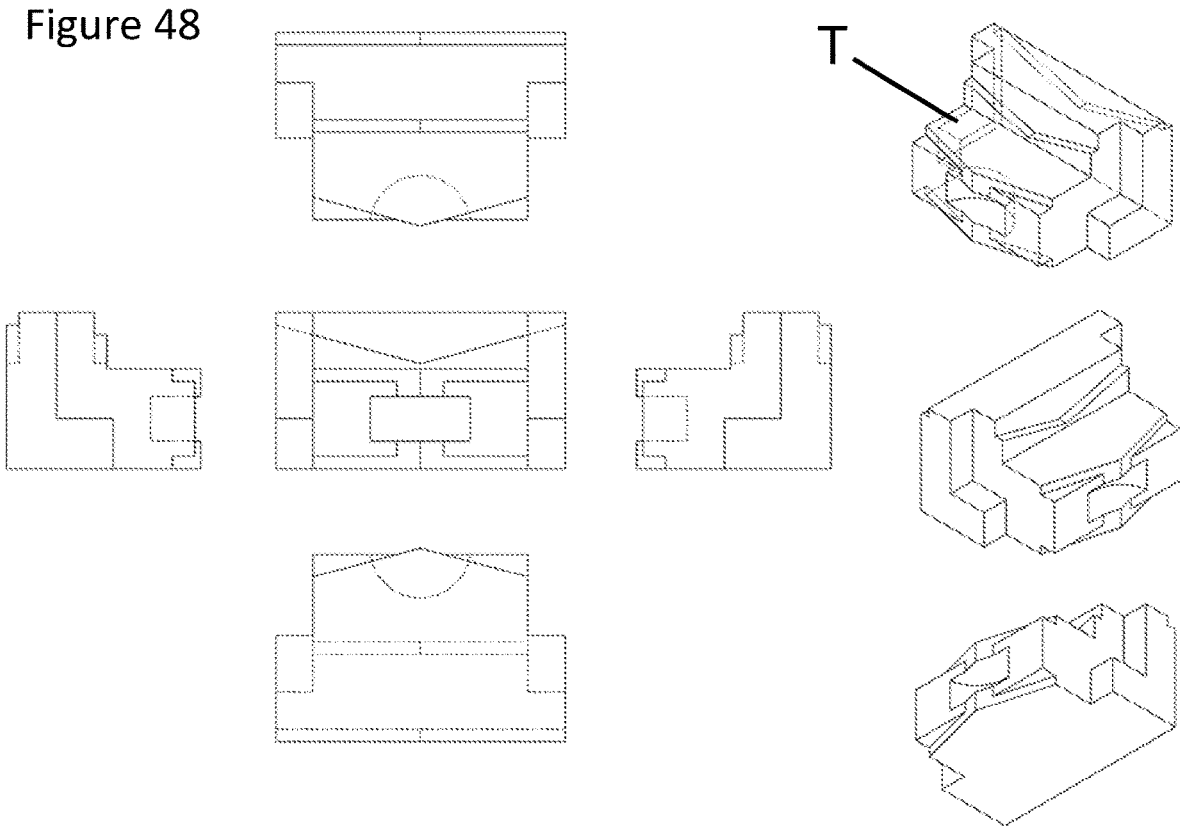
Figure 49:
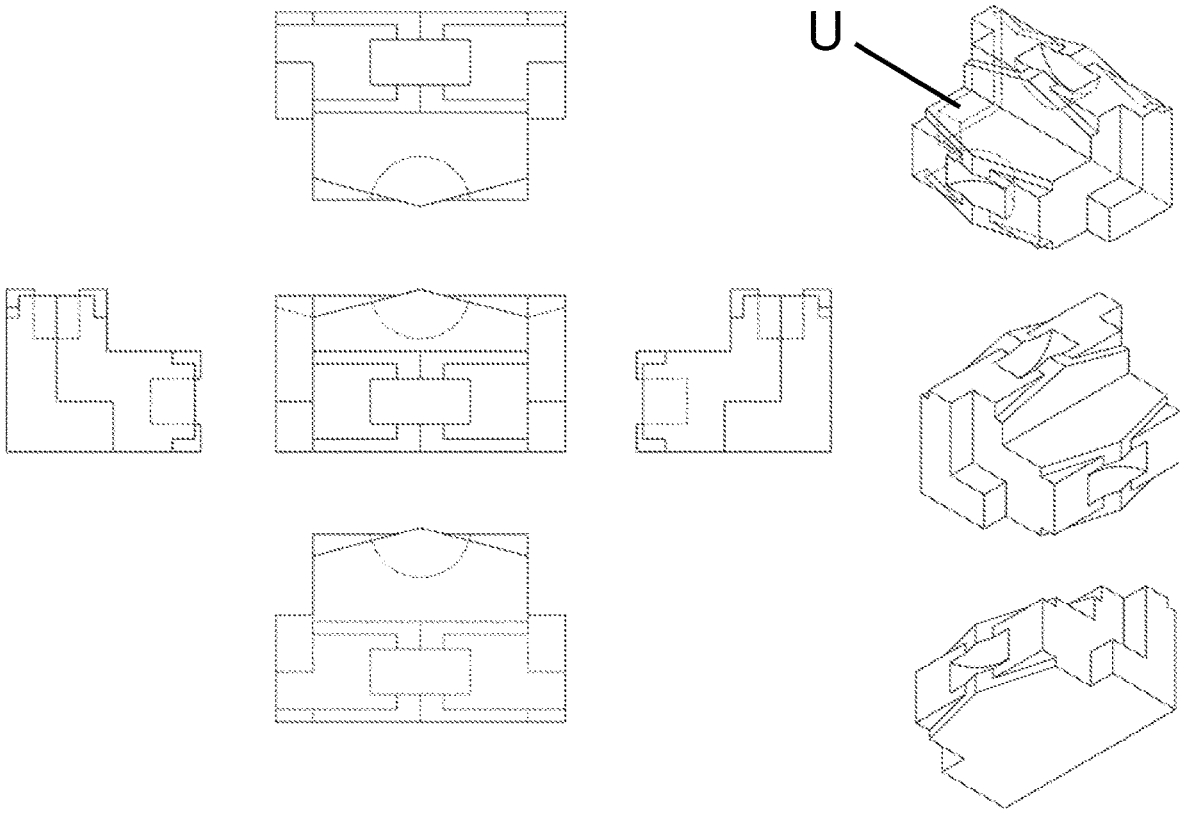

FIGS. 33 and 34 provide further examples of the use of the edge pieces of FIG. 29;

FIG. 35 is a perspective view of an architectural structure in the form of a square building in accordance with the present invention;

FIG. 36 is a cutaway perspective view showing some of the components of the building of FIG. 35;

FIGS. 37 to 49 each show detailed views of each of the previously described components.

Figure 1:
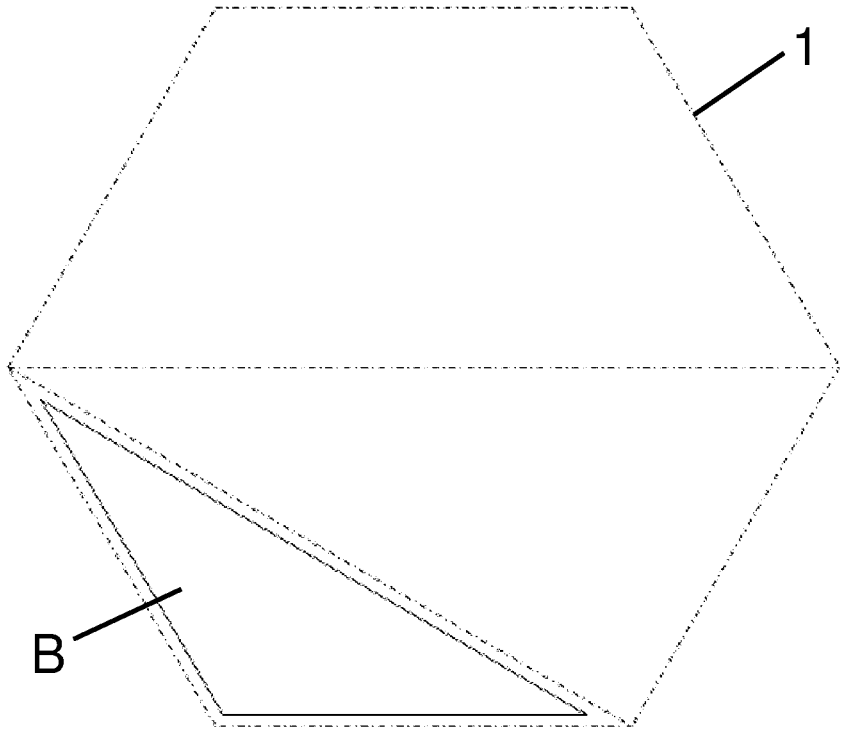
FIG. 1 shows an isosceles panel (B) transposed on a hexagon.

Referring now to FIG. 1, this shows the shape of an isosceles panel (B) transposed on a section of hexagon 1. The isosceles panel (B) has a vertex of 120°.

Figure 2:
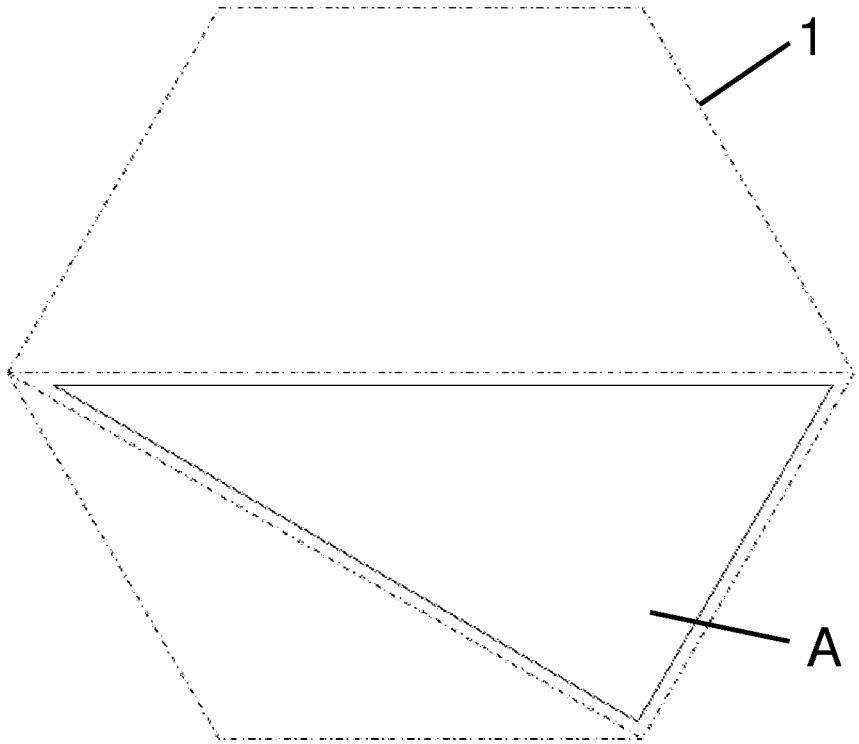
FIG. 2 shows a right angle panel (A) transposed on a different region of the hexagon of FIG. 1.

FIG. 2 shows a right angled panel (A) having vertices of 30°, 60° and 90° transposed on the same hexagon 1 as FIG. 1. From FIGS. 1 and 2 it can be observed that the isosceles panel (B) and the right angled panel (A) substantially cover the entire lower half of hexagon 1 and that two corresponding panels (A) and (B) may be arranged to cover the upper half of the hexagon 1, as viewed in FIGS. 1 and 2.

Figure 3:
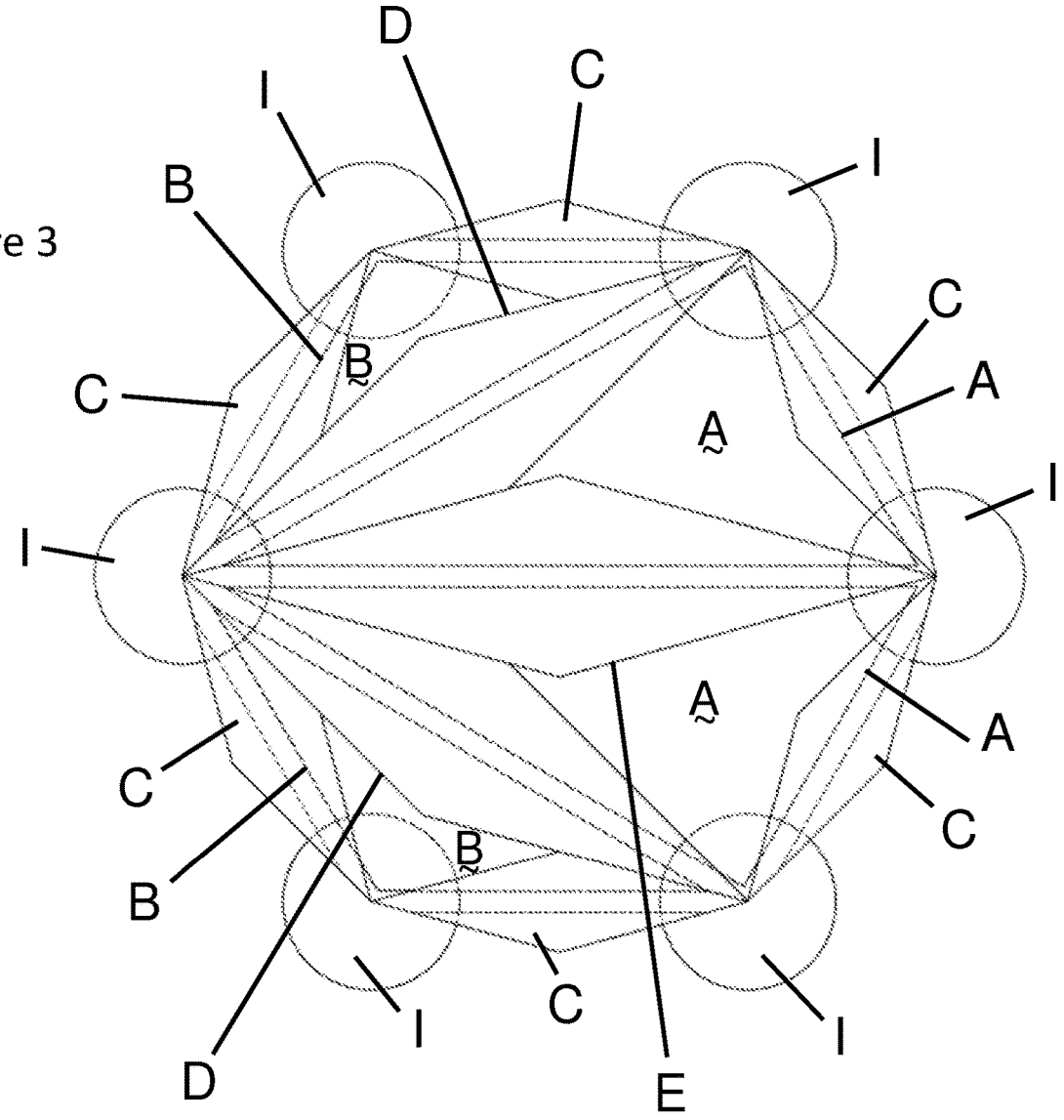
FIG. 3 illustrates how a number of isosceles panels (B) and right angle panels (A), together with appropriate connecting members, may be used to cover the entire area of the hexagon illustrated in FIGS. 1 and 2.

In FIG. 3, in the lower portion a right angled panel (A) and a isosceles panel (B) are laid out adjacent each other as shown with another two panels (A) and (B) laid out in a similar manner in the upper portion of figure, so that if they were transposed on the hexagonal of FIGS. 1 and 2 they would substantially cover the hexagon 1.

FIG. 3 additionally illustrates how three different sizes of connecting members (C), (D) and (E), shown in the perspective views in FIGS. 6, 7 and 8 respectively, may be arranged between and about the right angled panel (A) and isosceles panel (B), with six connectors discs (I) located at the vertices of the panels (A) and (B), so that all the components illustrated, together form a planar component, indicated generally as 2, which as will be described later, may form a building in accordance with the present invention.

Referring to FIGS. 4 and 5, these are perspective views of a right angled panel (A) and isosceles panel (B) respectively. Referring first to the right angled panel (A) of FIG. 4, this comprises two outer layers 3 and 4 of moulded aerated autoclaved concrete, between which there is an insulation layer, indicated generally as 5. The insulation layer itself comprises two outer layers 6 and 7 of MycoBoard™ which is grown on the concrete layers 3 and 4 with a MycoFoam™ layer 8 grown between the MycoBoard™ layers 6 and 7. The insulation layer 5 is cutaway in the region of the vertices of the isosceles panel (A) in order to accommodate the connecting discs (I) of FIG. 3, as will described later.

With reference to FIG. 5, the right angled panel (B) has the same construction as the isosceles panel (A) of FIG. 4 and corresponding components have been labelled in the same manner as in FIG. 4.

Figure 6:
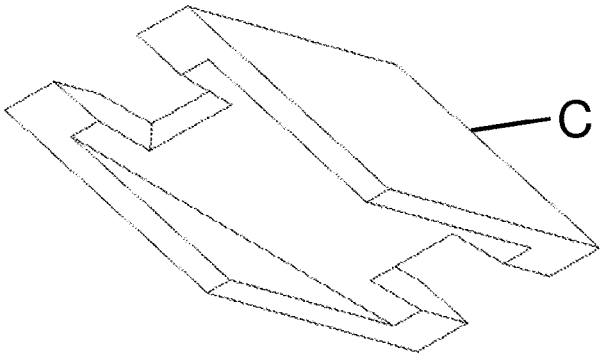
FIG. 6 is a perspective view of a small connecting member (C)
Figure 7:
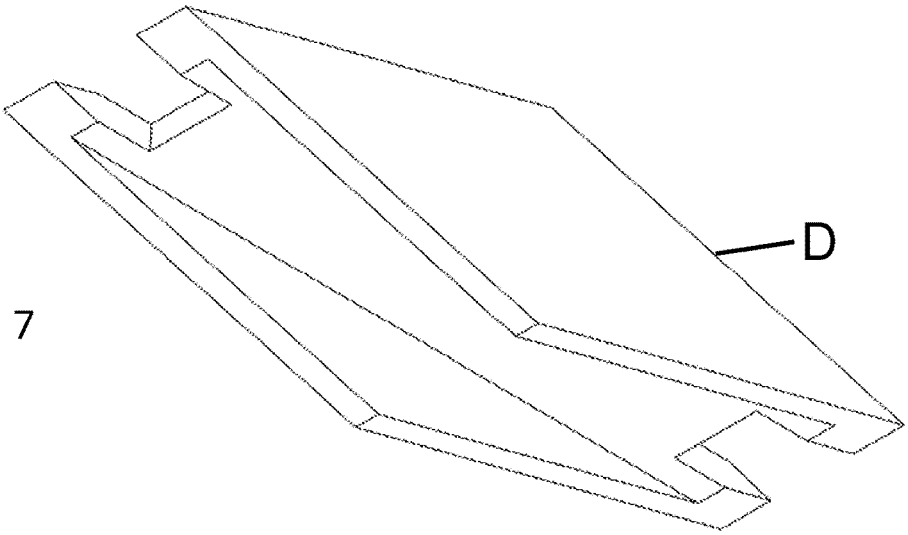
FIG. 7 is a perspective view of a medium connecting member (D)
Figure 8:
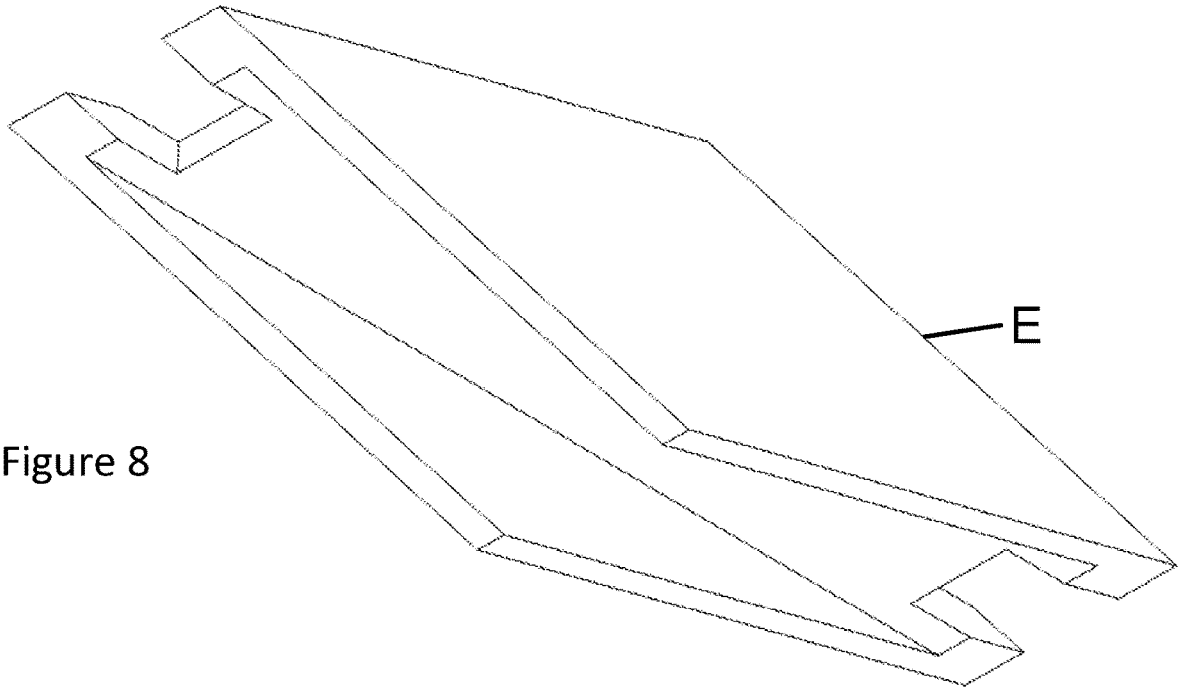
FIG. 8 is a perspective view of a large connecting member (E)

Referring to FIGS. 6, 7 and 8, these show perspective views of a small (C), medium (D) and large (E) connecting member, previously mentioned with reference to FIG. 3. These each have an I-shaped cross-section with opposed channels defined by the I-shaped cross-section being of the same width as the panels (A) and (B) and the panels (A) and (B) are a push fit into the connecting members (C), (D) and (E). The connecting members (C), (D) and (E) have a maximum dimension in a length direction which substantially corresponds to the length of one of the sides of either the right angled panel (A) or isosceles panel (B).

Each connecting member (C), (D) and (E) of FIGS. 6, 7 and 8 comprises front and rear diamond shaped planar portions with an orthogonal portion extending there between. This orthogonal portion is cutaway towards the ends in order to accommodate the connecting discs (I) of FIG. 3.

Figure 9:
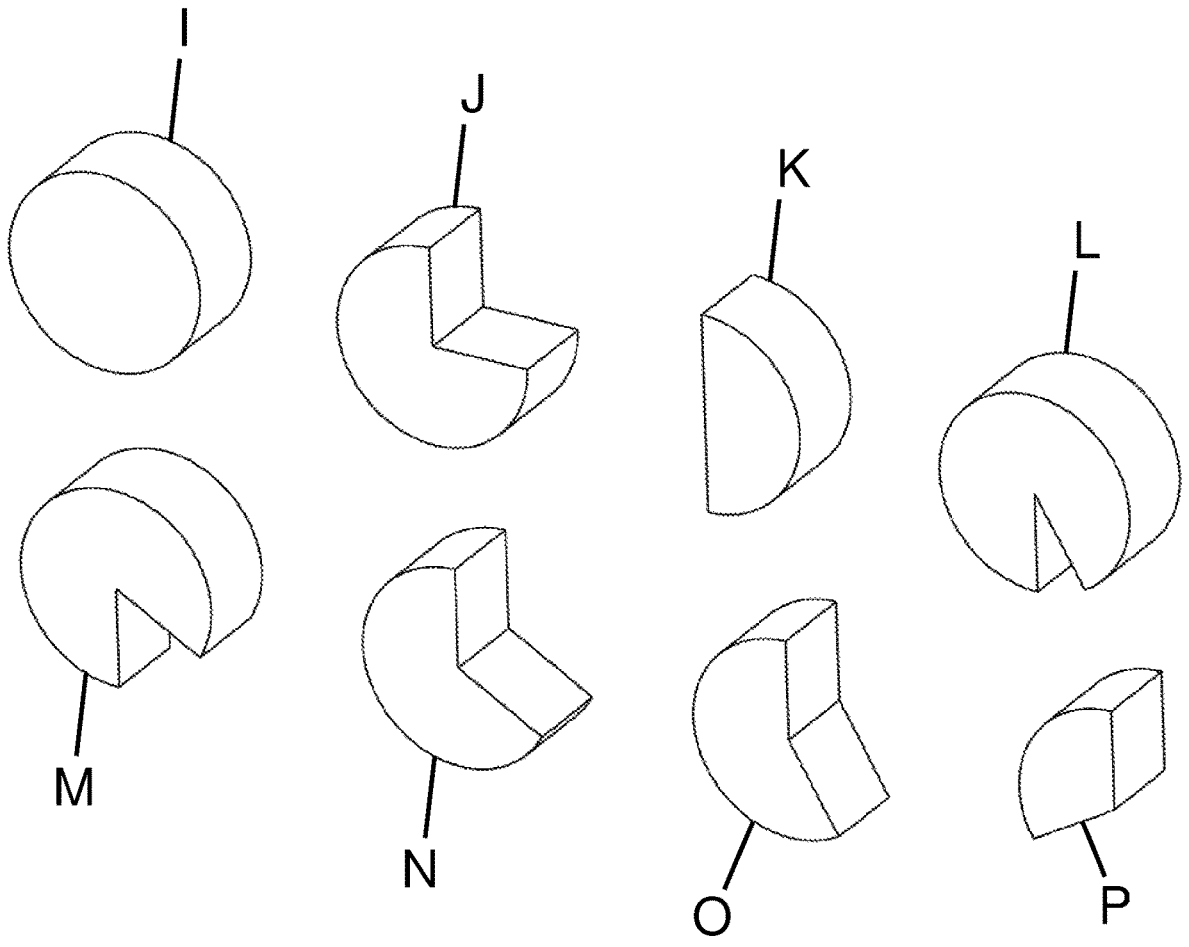
FIG. 9 is a perspective view of a selection of connector discs (I to P)

Referring to FIG. 9, this shows a perspective view of one of the connecting discs (I) and seven other partial connecting discs, comprising: a three quarter disc (J); a half disc (K); a 30° angled disc (L); a 60° angled disc (M); a 120° angled disc (N); a 150° angled disc (O); and a 240° angled disc (P). The function of these partial discs (J) to (P) will become apparent with reference to the description of the following figures. All connecting discs are formed of a thermally insulating material.

Figure 10:
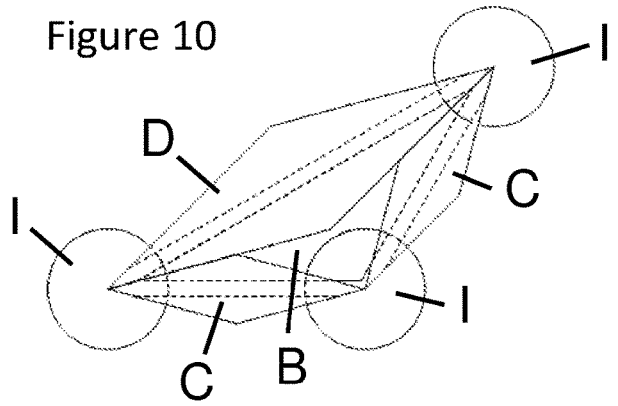
FIG. 10 illustrates how an isosceles panel (B) may be bordered by three connecting members and three connector discs.
Figure 12:
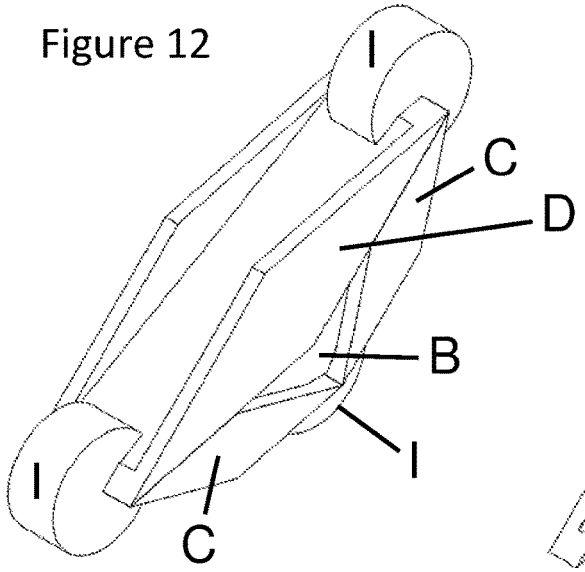
FIG. 12 is a perspective view corresponding to FIG. 10.
Figure 13:
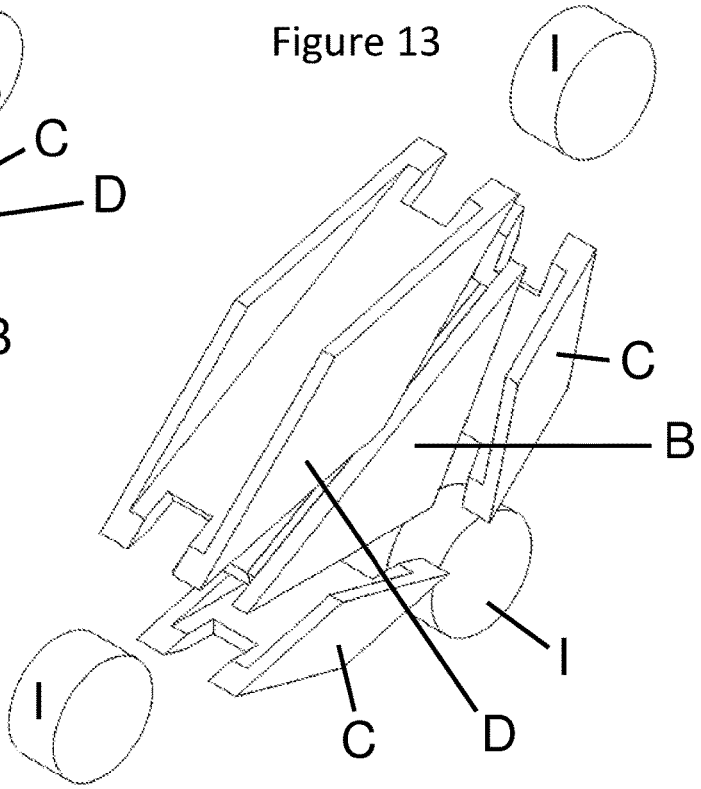
FIG. 13 is a perspective view corresponding to FIG. 11.

With reference to FIG. 10, this illustrates how an isosceles panel (B) may be bounded by the medium connecting member (D) of FIG. 7, two small connecting members (C) of FIG. 6 and three connecting discs (I). These components are shown in exploded view in FIG. 11 and in perspective views 12 and 13, with FIGS. 12 and 13 perhaps most clearly indicating how the isosceles panel (B) slots into the channels of the connecting members.

Figure 11:
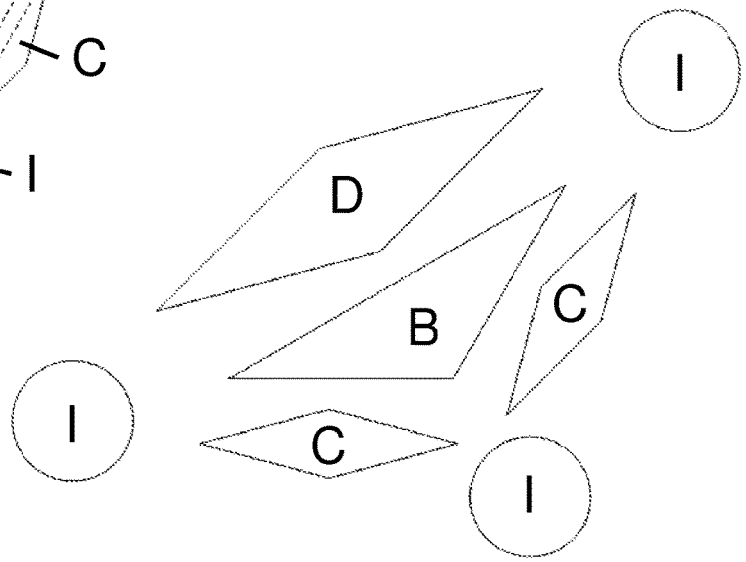
FIG. 11 is an exploded view of the components of FIG. 10.
Figure 14:
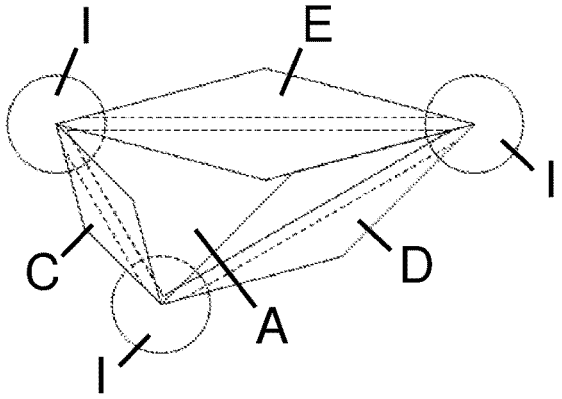
FIG. 14 illustrates how a right angled panel (A) may be bordered by three connecting members and three connector discs.
Figure 15:
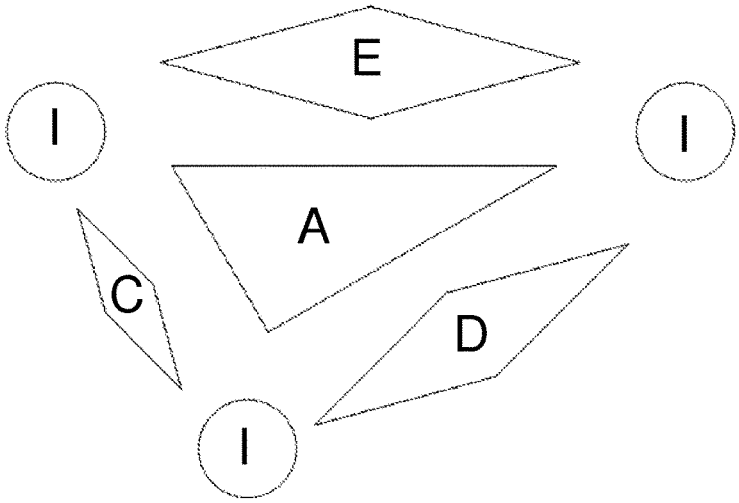
FIG. 15 is an exploded view of the components of FIG. 14.

FIGS. 14 and 15 correspond respectively to FIGS. 10 and 11, but illustrate connecting members and connecting discs bordering a right angle panel (A).

Figure 16:
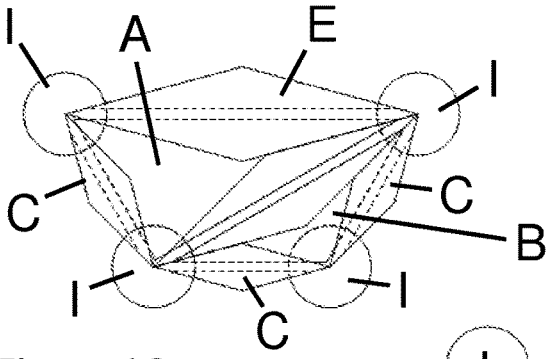
FIG. 16 illustrates how a right angled panel (A) and isosceles panel (B) may be placed adjacent to each other and joined by an appropriate connecting member, with appropriate further connecting members and connector discs positioned about the two panels.
Figure 17:
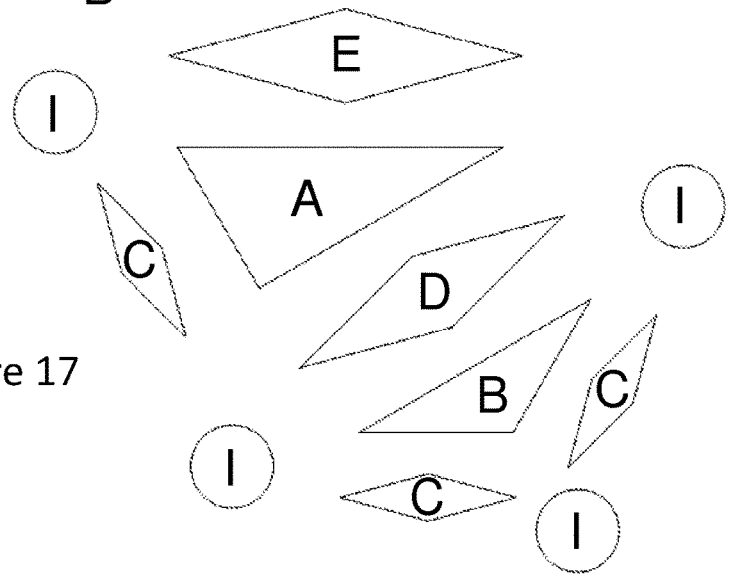
FIG. 17 is an exploded view of the components of FIG. 16.

FIGS. 16 and 17 are similar to views of FIGS. 14 and 15 but show a right angled panel (A) adjacent an isosceles panel (B) with an intervening connecting member (D) there between.

Figure 18:
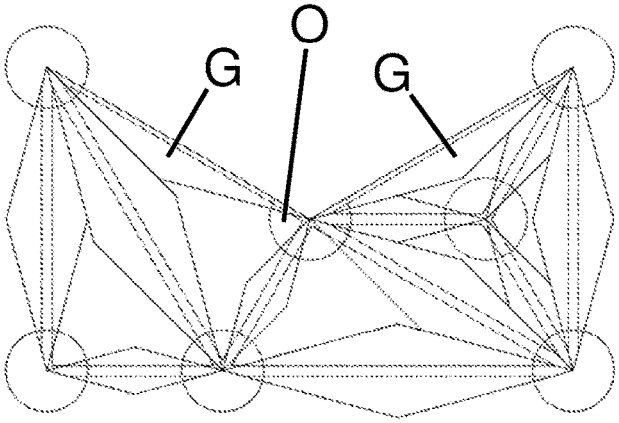
FIG. 18 illustrates how various panels, connecting members, connector discs and edge pieces may be arranged together.
Figure 19:
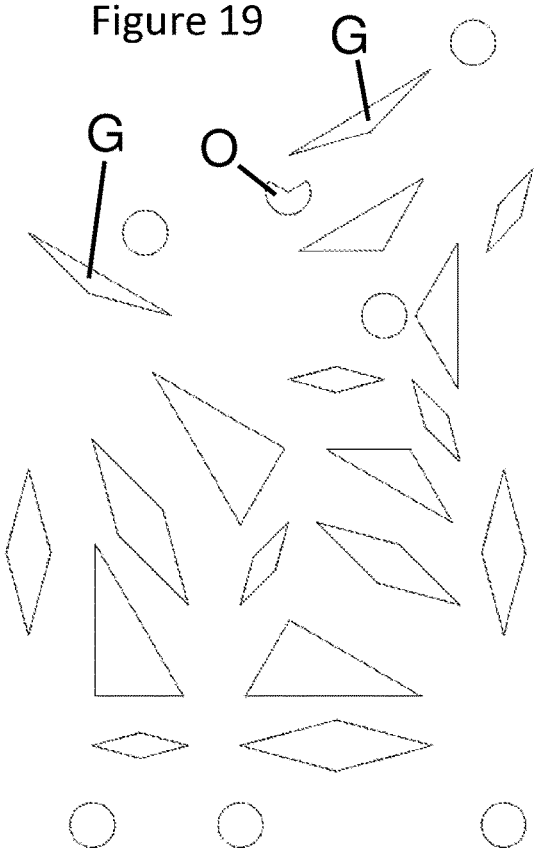
FIG. 19 is an exploded view of the components of FIG. 18.

Referring to FIGS. 18 and 19, these are similar to FIGS. 16 and 17, but show a more complex structure comprising many more components. Two of the structures show in FIG. 18, one inverted upon the other, will result in the planar wall component 9 illustrated in FIG. 33, forming the right-hand wall of the building illustrated in FIG. 21, described below.

FIGS. 18 and 19 disclose additional components in the form of medium edge pieces (G) each of which essentially corresponds to a half of one of the medium connecting members (D). These are used to provide straight edges for the aperture of the window shown in FIG. 33. FIGS. 18 and 19 also illustrate the use of a 150° angled connector disc (O). This is necessary for if a full connector disc (I) were used instead, it would extend into the region of the window (see FIG. 18).

Figure 20A:
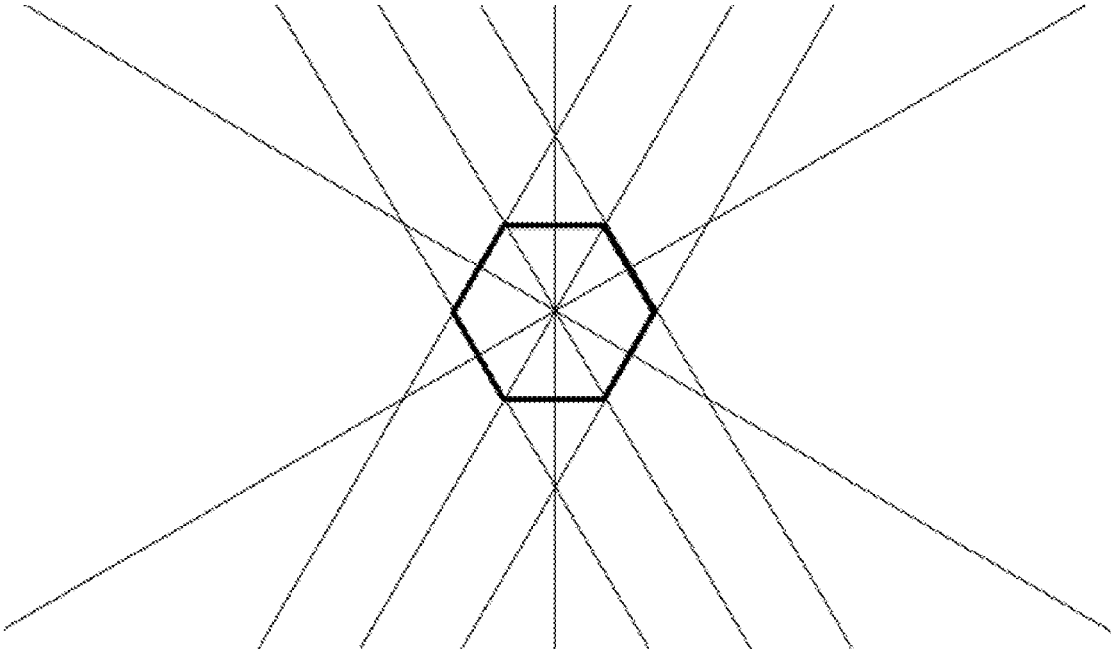
FIG. 20A illustrates how a hexagon may be used to create a grid pattern.
Figure 20B:
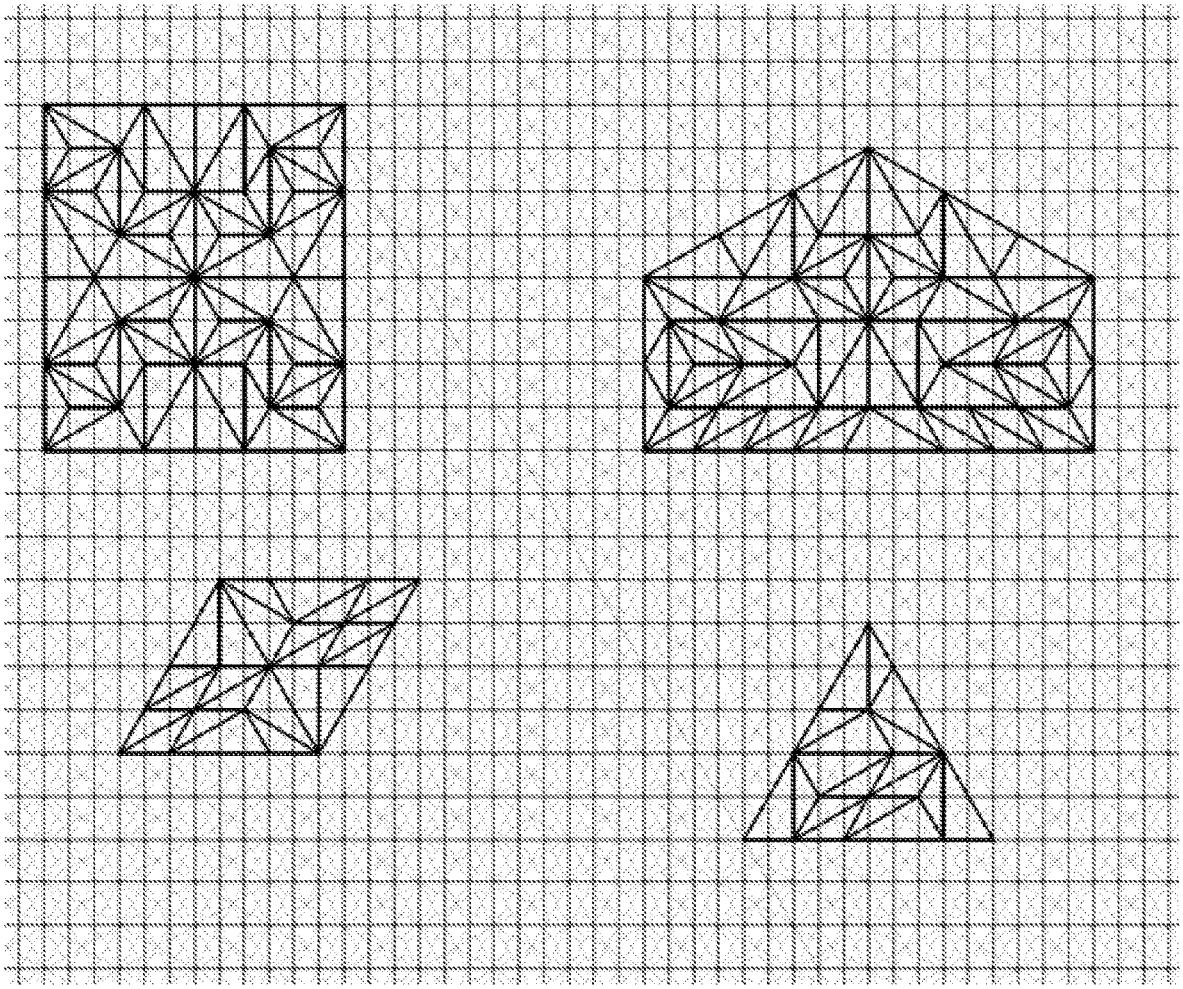
FIG. 20B illustrates some of the potential shapes which may be created with the panels and connecting members being overlaid on the grid of FIG. 20A.

Referring now to FIG. 20A, this illustrates how a grid pattern may be obtained by extrapolating lines intersecting the vertices of a hexagon and by extrapolating lines which in turn intersect the intersections of those lines. FIG. 20B then illustrates how various shaped structures formed from the previously described components may be overlaid on the grid of FIG. 20A.

Figure 21:
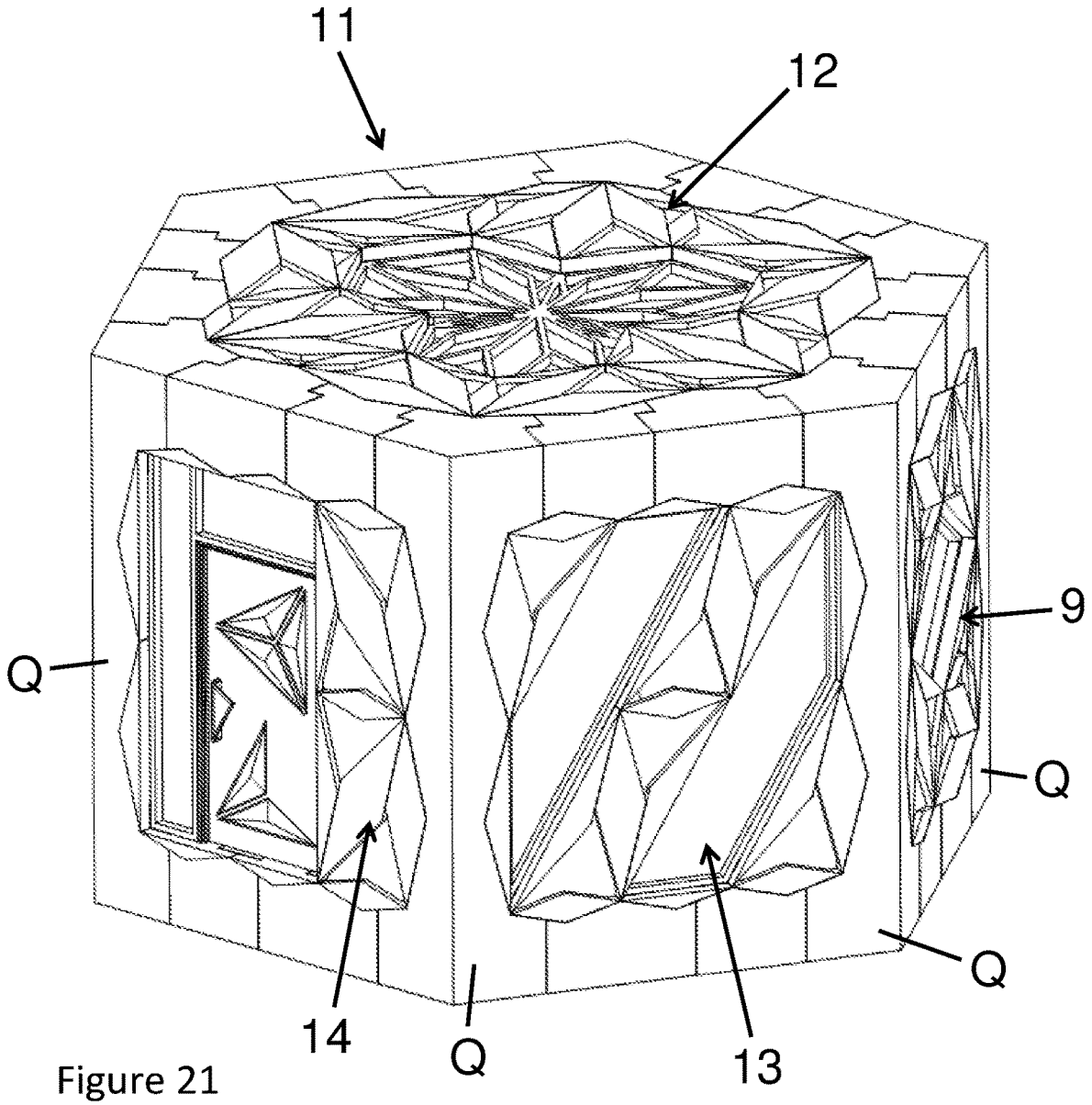
FIG. 21 is an architectural structure in the form of a building constructed from the components illustrated in FIGS. 1 to 19.
Figure 22:
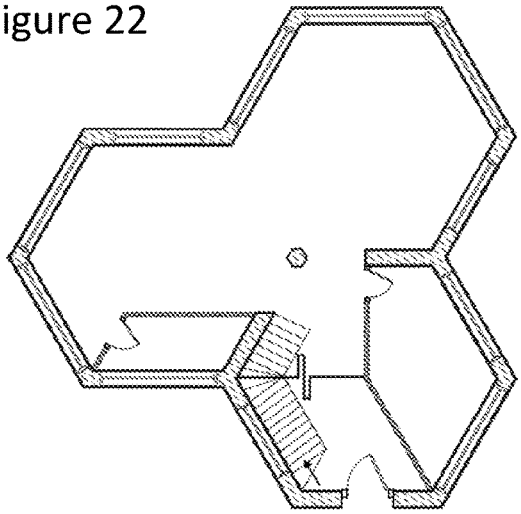
FIGS. 22 and 23 illustrate possible floorplans of the building illustrated in FIG. 24.
Figure 23:
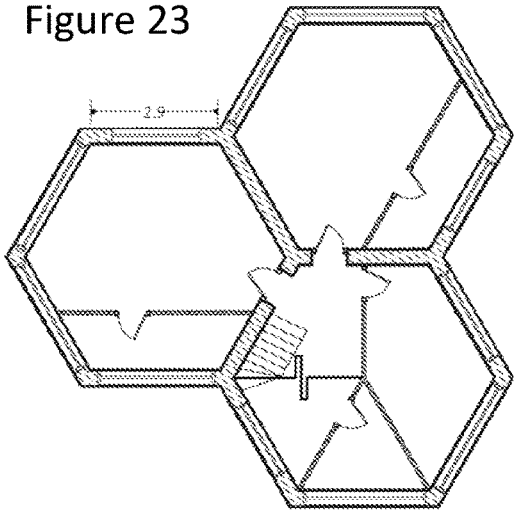
Figure 24:
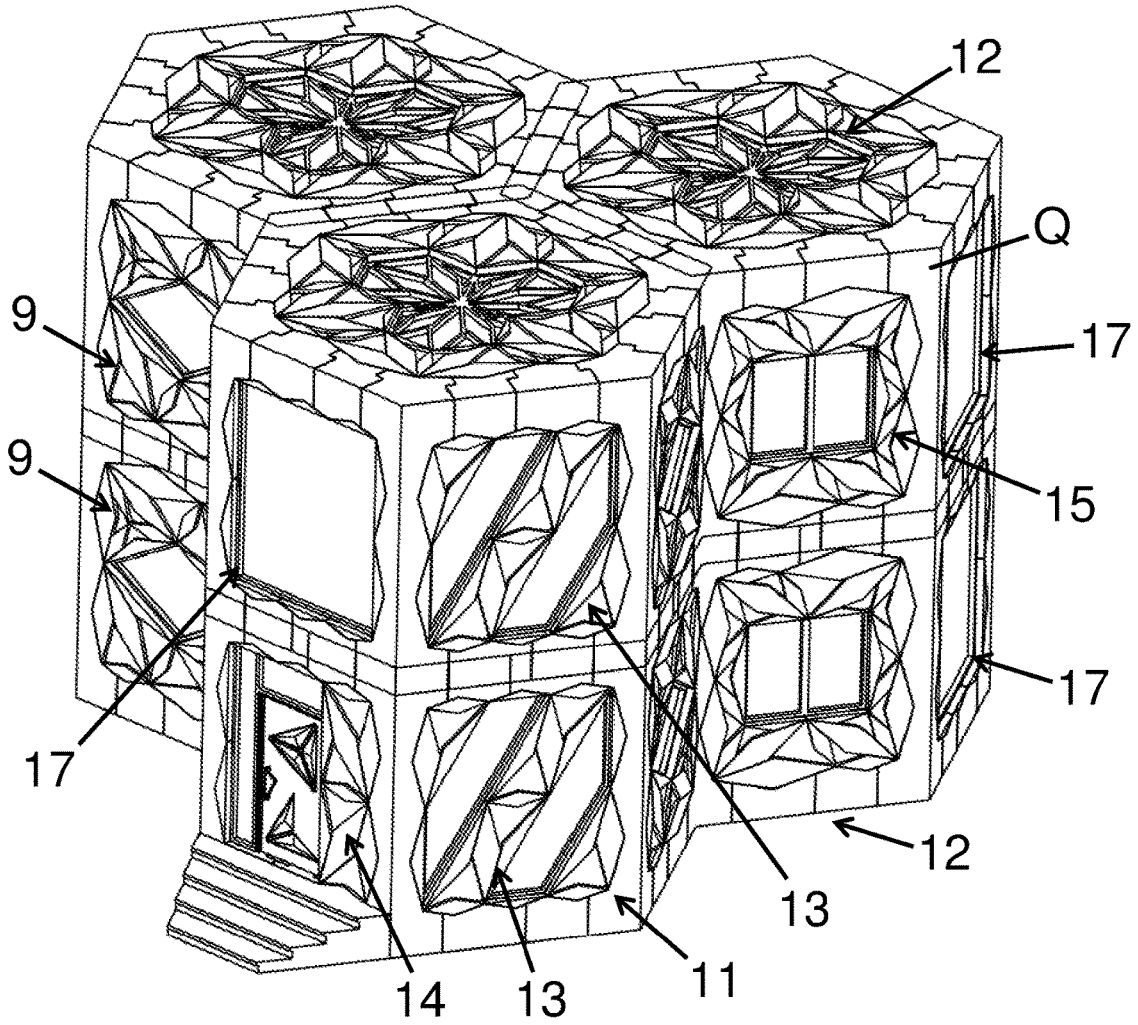
FIG. 24 is an architectural structure in the form of a building constructed from multiple structures similar to the one shown in FIG. 21.

Referring now to FIG. 21, there is illustrated an architectural structure in accordance with the present invention which is in the form of a building, indicated generally as 11. The octagonal structure, in plan view, is one of the simplest to construct from the components previously described. However, it will be appreciated from the ground floor plan of FIG. 22, the upper floor plan of FIG. 23 and the perspective view of the building, indicated generally as 12, in FIG. 24, how the building 11 shown in FIG. 21 may be used as a primary module of a larger building, for example that illustrated in FIG. 24.

Figure 25:
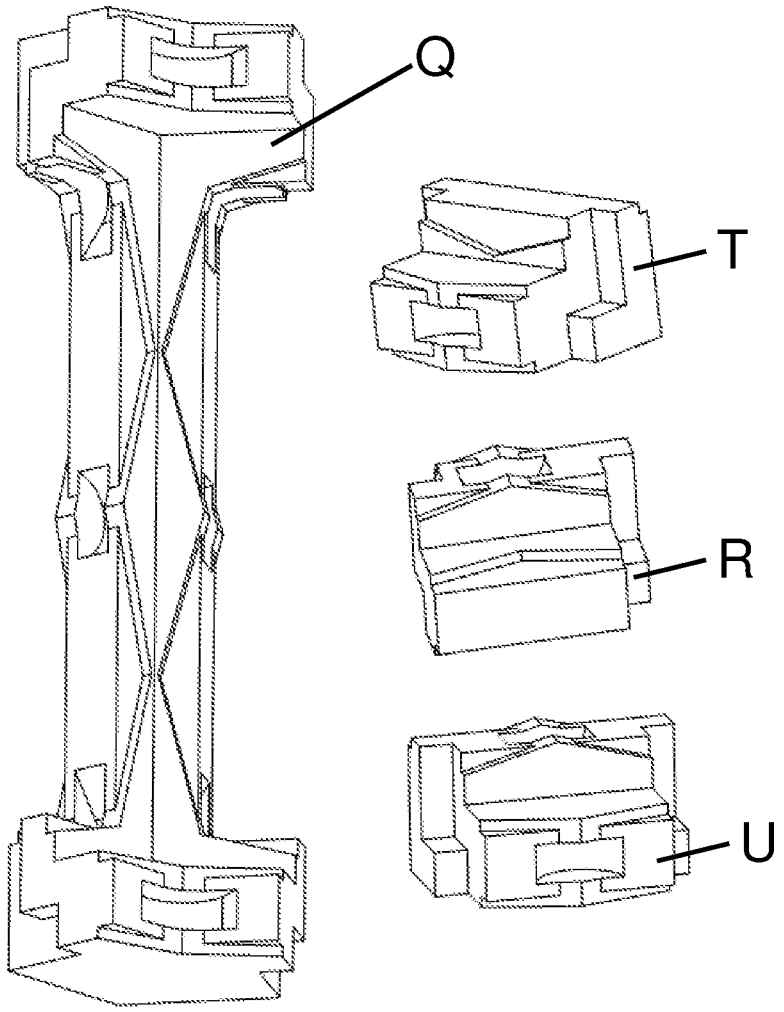
FIG. 25 is a perspective view of a frame corner connector (Q), a first frame connector (R), a second frame connector (T) and a third frame connector (U) of the buildings of FIGS. 21 and 24.

With reference again to the building 11 of FIG. 21, this has a floor and a roof comprising planar hexagonal components, which may be preassembled from previously described components or, in the case of the open roof structure 12, similar components. The building 11 further comprises wall panels 9, 13, 14, 15, 16 and 17 of several styles (panels 15, 16 and 17 are not visible but can be seen in the building 12 of FIG. 24 or the building 18 of FIG. 35, which is described below). The constructions of the right-hand wall panel 9 has been previously described with reference to FIGS. 18, 19 and 33. The other wall panels 13 to 17 are constructed similarly. However, as will be appreciated from FIG. 21, the building 11 of FIG. 21, in addition to the planar roof and the floor and wall panels, comprises six corner connectors (Q), only four of which can be seen if FIG. 21. One of these is illustrated in the perspective view of FIG. 25, and several types of frame connector (R), (T) and (U) are also shown in perspective view in FIG. 25, which form the top and bottom outer edges of the building 11 of FIG. 21.

Figure 26:
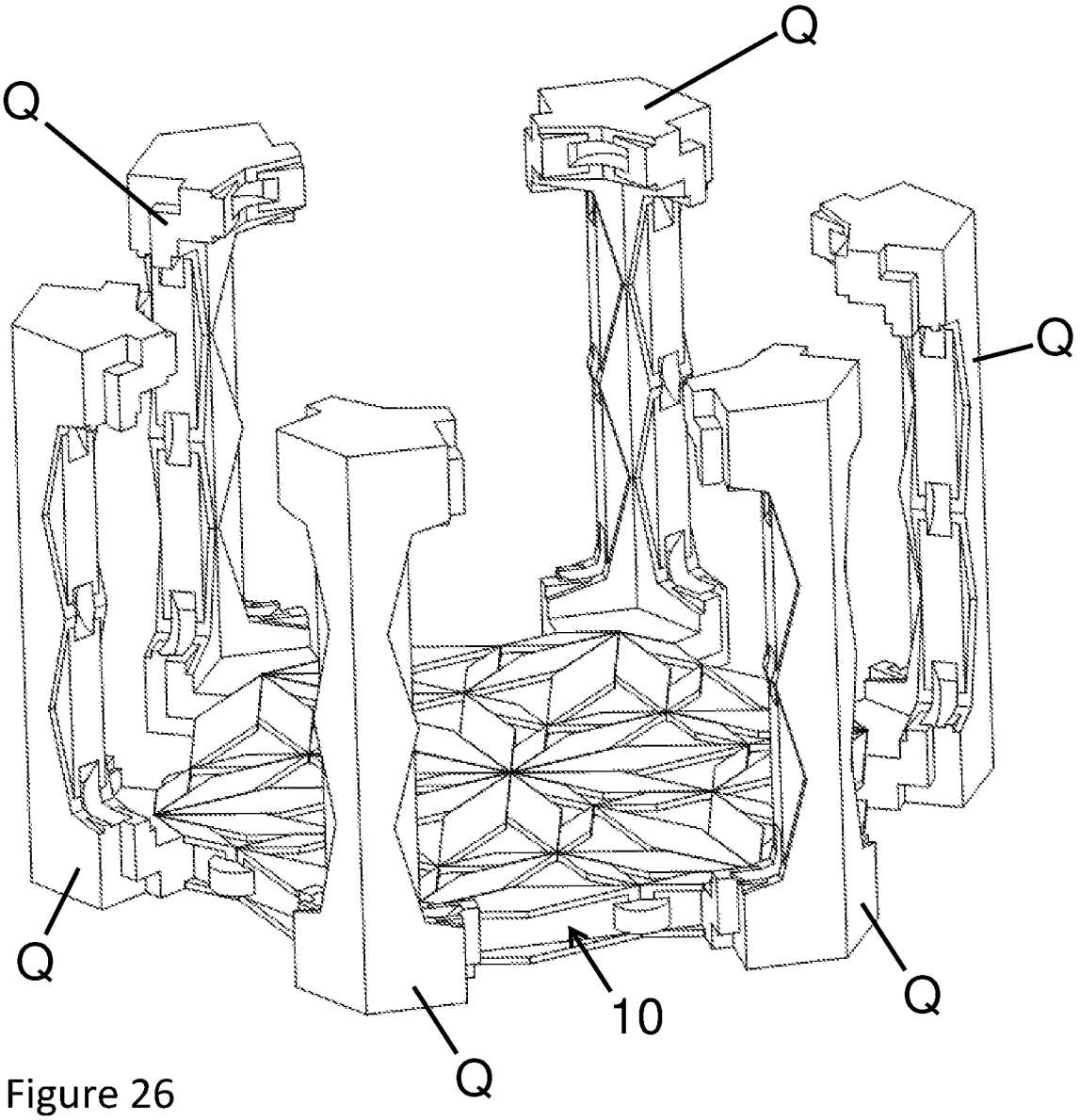
FIG. 26 shows the floor and six frame corner connectors (Q) of the building of FIG. 21.

FIG. 26 illustrates how six frame corner connectors (Q) may be arranged around a floor panel 10. Also from FIG. 26 it will be appreciated how the various frame connectors (T), (R) and (U) of FIG. 25 may be arranged around the lower and upper perimeters of the frame to provide the structure of the building 11 shown in FIG. 21. Unless the wall panels are to be constructed on site then the preassembled wall panels will need to be inserted at the same time as the frame corner connectors (Q) are assembled in to position.

Figure 27:
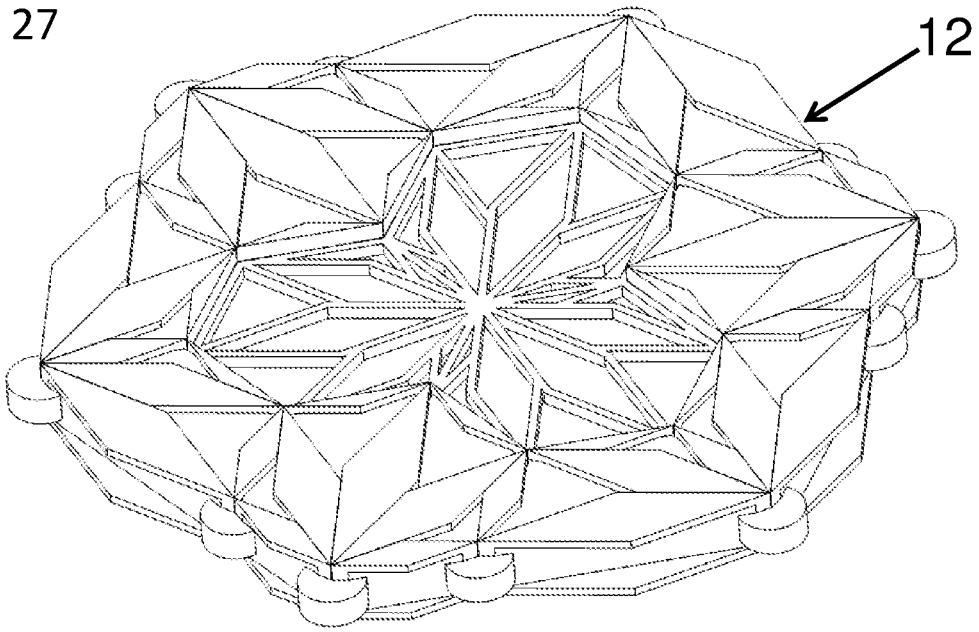
FIG. 27 shows a preassembled planar component of the roof of the building of FIG. 21.
Figure 28:
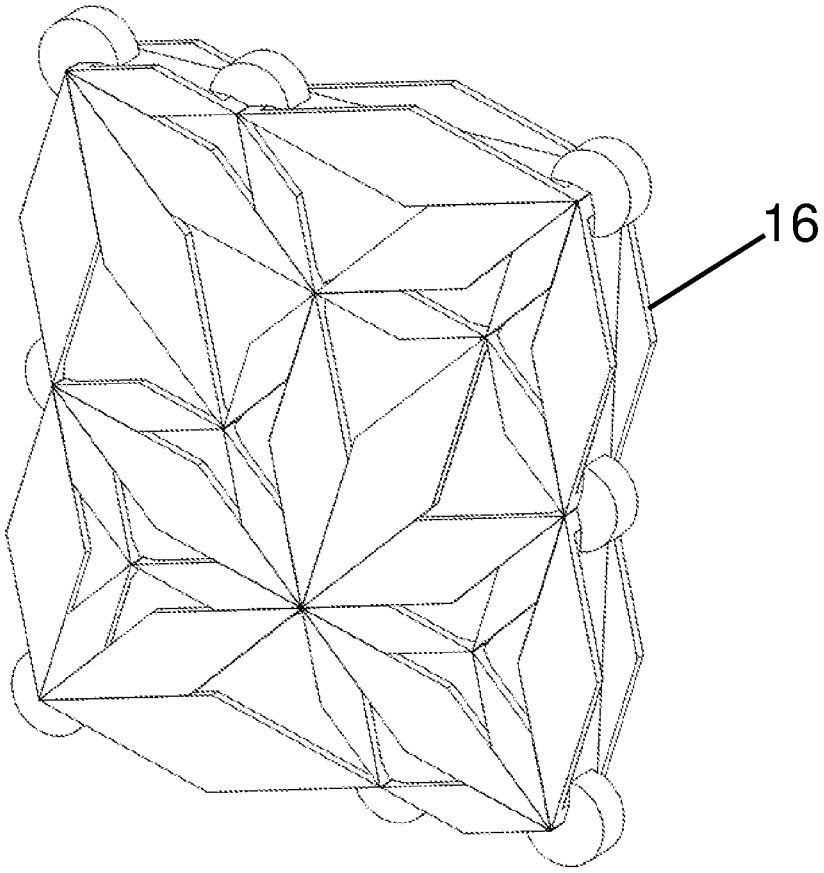
FIG. 28 shows a preassembled planar component of a rear wall of the building of FIG. 21.

Referring to FIG. 27 there is shown the roof panel 12 for the building illustrated in FIG. 21 and FIG. 28 shows the fully enclosed back wall panel 16 for the building 18 of FIG. 35.

FIG. 29 shows perspective views of the small edge piece (F), the medium edge piece (G) and the large edge piece (H) used to border the apertures in the wall panels 9, 13, 14, 15 and 17 and these panels are shown in greater detail in respective ones of FIGS. 30 to 34.

So far only buildings 11 and 24 have been referred to, each comprising a hexagonal structure. However, the invention is equally applicable to other shapes of building, for example the square building indicated generally as 18 in FIG. 35 and this is shown partially assembled in FIG. 36.

The various components so far described can be seen in greater detail in each of FIGS. 37 to 49. The dimensions given in these Figures are by way of example only and are appropriate for the particular structures previously described. However, it will be appreciated that even for those same structures the dimensions of all the components may be scaled up or down.

Several examples of the present invention have been described by way of example only and it will be appreciated that many modifications and variations may be made which will be encompassed within the scope of the present invention, as defined by the following claims.

The invention claimed is:

1. An architectural structure comprising at least one planar component in a form of a wall, floor, or ceiling, the at least one planar component comprising (i) a plurality of identically sized isosceles panels each having a form of a 30°-120°-30° isosceles triangle and (ii) a plurality of identically sized right angled panels each having a form of a 30°-60°-90° right angled triangle, wherein the at least one planar component further comprises connecting members, separate to the isosceles panels and right angled panels, located between adjacent panels of (i) the plurality of isosceles panels and (ii) the plurality of right angled panels, to hold the panels in position without requiring a bonding agent between adjacent panels, and wherein at least one right angled panel forms a part of the planar component and is surrounded on each side thereof by other panels of (i) the plurality of isosceles panels additionally forming said planar component and/or (ii) the plurality of right angled panels additionally forming said planar component.

2. The architectural structure as claimed in claim 1, wherein, with the exception of a peripheral edge portion, an entirety of the planar component comprises and is substantially filled by non-overlapping panels of (i) the plurality of isosceles panels and (ii) the plurality of right angled panels.

3. The architectural structure as claimed in claim 1, wherein each right angled panel of the plurality of right angled panels has a long side with a length that is approximately 1.2 times a length of a long side of each isosceles panel of the plurality of isosceles panels.

4. The architectural structure as claimed in claim 1, wherein each connecting member comprises a planar front portion, a planar rear portion, and an orthogonal portion extending between the planar front and planar rear portions to define a channel for receiving an edge of a panel of the plurality of isosceles panels or the plurality of right angled panels, wherein a width of the channel is substantially equal to a thickness of the panel.

5. The architectural structure as claimed in claim 4, wherein for each connecting member, at least one of the planar front and planar rear portions extend sufficiently to cover any gaps between adjacent panels of the plurality of isosceles panels and/or the plurality of right angled panels.

6. The architectural structure as claimed in claim 4, wherein for each connecting member, the planar front and planar rear portions are registered with each other, and wherein each connecting member defines two back-to-back channels for receiving respective edges of adjacent panels of the plurality of isosceles panels and/or the plurality of right angled panels.

7. The architectural structure as claimed in claim 6, wherein for each connecting member, farthest apart tips of the planar front and planar rear portions subtend an angle of 30°.

8. The architectural structure as claimed in claim 1, wherein the connecting members comprise three types of connecting member which are essentially identical in shape but are of three different sizes, with each connecting member having a maximum length dimension slightly greater than a length dimension of an edge of an isosceles panel or a right angled panel to which the connecting member is adjacent in the planar component.

9. The architectural structure as claimed in claim 1, wherein the connecting members consist of a single type of connecting member, of which appropriate multiples may be placed end-to-end so that the combined lengths of different multiples are each slightly greater than a length of an edge of an isosceles panel or a right angled panel to which each multiple is positioned adjacent in the planar component.

10. The architectural structure as claimed in claim 1, wherein each connecting member is homogenous and is formed by casting or molding.

11. The architectural structure as claimed in claim 1, wherein each connecting member is formed of concrete.

12. The architectural structure as claimed in claim 1, wherein each panel of the plurality of isosceles panels and the plurality of right angled panels is a structurally insulated panel comprising two outer layers and an inner insulating layer.

13. The architectural structure as claimed in claim 12, wherein the insulating layer has a cut-out formed at each vertex in the form of a part of a circle and wherein the at least one planar component further comprises a plurality of circular discs of insulating material of a same thickness as the insulating layers, wherein circular discs of the plurality of circular discs are positioned between adjacent vertices of adjacent panels of the plurality of isosceles panels and/or the plurality of right angled panels.

14. The architectural structure as claimed in claim 1, comprising at least one peripheral frame for receiving an edge of the at least one planar component, wherein the at least one peripheral frame comprises a plurality of frame components being shaped on an outer side to have a straight edge and a shaped inner edge configured to receive the planar component.

15. The architectural structure as claimed in claim 1, further comprising a plurality of edge pieces which each correspond in shape and size to half of one of the connecting members located between the adjacent panels of the plurality of isosceles panels and/or the plurality of right angled panels, wherein each edge piece is configured to fit over an edge of a panel and provide a smooth edge to the panel.

16. The architectural structure as claimed in claim 1, in the form of a building, wherein at least one wall of the building comprises the at least one planar component, wherein the building comprises a peripheral frame shaped for receiving the at least one planar component, the peripheral frame comprising two opposed upright corner pillars between which the at least one planar components is located, the architectural structure comprising at least two planar components, wherein one of said corner pillars is located between the two planar components and is shaped to receive respective adjacent edges of the planar components when the two planar components are angled relative to each other.

17. The architectural structure as claimed in claim 16, wherein the building is at least partly orthogonal and comprises a plurality of planar components comprising walls angled at corner pillars to each other to form at least part of an orthogonal structure.

18. The architectural structure as claimed in claim 16, wherein at least one wall of the building is formed by stacking connecting members and panels of the plurality of isosceles panels and/or the plurality of right angled panels on site to form said at least one wall.

19. A method of constructing an architectural structure as claimed in claim 1 in the form of a building, the method comprising assembling a planar component to form a wall, floor or ceiling from a plurality of identical isosceles panels each having the form of a 30°-120°-30° isosceles triangle and from a plurality of identical right angled panels each having the form of a 30°-60°-90° right angled triangle, the method comprising assembling the isosceles panels and the right angled panels using intervening connecting members without any binder between adjacent panels of the isosceles panels and the right angled panels.

20. The architectural structure as claimed in claim 1 wherein at least some panels of (i) the plurality of isosceles panels and/or (ii) the plurality of right angled panels have a mid-portion between outer major faces, the mid-portion having a cut-out portion in the form of a part of a circle formed at each vertex, with the at least one planar component further comprising a plurality of circular discs of a same thickness as a thickness of each cut-out portion, wherein circular discs of the plurality of circular discs are positioned between adjacent vertices of adjacent panels and are accommodated in the cut-out portions of the adjacent panels.

* * * * *